US008105174B1

(12) United States Patent
Schofield, Sr. et al.

(10) Patent No.: US 8,105,174 B1
(45) Date of Patent: Jan. 31, 2012

(54) COMPUTERIZED METHOD AND SYSTEM FOR ADMINISTERING UNIVERSAL RATING OF POCKET BILLIARD PLAYERS

(76) Inventors: Paul E Schofield, Sr., McKean, PA (US); Stephen M Schofield, Westerville, OH (US)

( * ) Notice: Subject to any disclaimer, the term of this patent is extended or adjusted under 35 U.S.C. 154(b) by 298 days.

(21) Appl. No.: 12/605,064

(22) Filed: Oct. 23, 2009

Related U.S. Application Data

(63) Continuation-in-part of application No. 11/676,421, filed on Feb. 19, 2007, now abandoned.

(60) Provisional application No. 60/766,927, filed on Feb. 21, 2006.

(51) Int. Cl.
*A63D 5/08* (2006.01)

(52) U.S. Cl. ..... 473/43

(58) Field of Classification Search ..... 473/1–22, 473/40–43; 273/123 R
See application file for complete search history.

(56) References Cited

U.S. PATENT DOCUMENTS

| | | | | |
|---|---|---|---|---|
| 4,784,388 | A * | 11/1988 | Owen | 473/1 |
| 5,350,171 | A * | 9/1994 | Wozniak | 473/1 |
| 5,800,273 | A * | 9/1998 | Potocki | 473/1 |
| 6,644,662 | B1 * | 11/2003 | Cao et al. | 273/123 R |
| 6,761,642 | B2 * | 7/2004 | Ye | 473/1 |
| 6,986,714 | B2 * | 1/2006 | Porper et al. | 473/1 |
| 7,134,965 | B1 * | 11/2006 | Deasy | 473/1 |

* cited by examiner

*Primary Examiner* — Ronald Laneau
(74) *Attorney, Agent, or Firm* — Robert M. Bauer; Knox McLaughlin Gornall and Sennett, P.C.

(57) ABSTRACT

A billiards player rating system includes a computer, a display associated with the computer, and at least one storage device. The computer determines a universal rating for a billiards player by prompting the entry of break counts of the billiards player into the computer with a user interface displayed on the display, determining a current average and a best average of the break counts entered into the computer for the billiards player, and calculating the universal rating for the billiards player from the current average and best average of break counts. The billiards player rating may be the only function of the computer or the computer may be a general-purpose computer which may selectively function in that manner by executing a computer program.

4 Claims, 34 Drawing Sheets

SCHOFIELD
UNIVERSAL RATING SYSTEM

R-8

REGULATION-TABLE EIGHT-BALL RATINGS

GRAND CHAMPION DIVISION (0)

| * | PLAYER | LEVEL | Best Average | Current Average |
|---|---|---|---|---|

CHAMPION DIVISION (1)

| * | PLAYER | LEVEL | Best Average | Current Average |
|---|---|---|---|---|

CHALLENGER DIVISION (2)

| * | PLAYER | LEVEL | Best Average | Current Average |
|---|---|---|---|---|

RIVAL DIVISION (3)

| * | PLAYER | LEVEL | Best Average | Current Average |
|---|---|---|---|---|

COMPETITOR DIVISION (4)

| * | PLAYER | LEVEL | Best Average | Current Average |
|---|---|---|---|---|

PLAYER DIVISION (5)

| * | PLAYER | LEVEL | Best Average | Current Average |
|---|---|---|---|---|

BREAKER DIVISION (6)

| * | PLAYER | LEVEL | Best Average | Current Average |
|---|---|---|---|---|

PLAYERS WITH DESIGNATED OR INVALID RATINGS

| * | PLAYER | Best Average | Current Average |
|---|---|---|---|

| * | RATING STATUS | PLAYER STATUS COMMITTEE |
|---|---|---|
| C | CERTIFIED | Committee Member |
| P | PROVISIONAL | Committee Member |
| D | DESIGNATED | Committee Member |
| I | INVALID | Committee Member |

Figure 34a

COMPUTERIZED METHOD AND SYSTEM FOR ADMINISTERING UNIVERSAL RATING OF POCKET BILLIARD PLAYERS

This application is a Continuation-in-part application of U.S. Non-Provisional patent application Ser. No. 11/676,421 filed on Feb. 19, 2007 now abandoned, which in turn claims priority to U.S. Provisional Patent Application No. 60/766,927 filed on Feb. 21, 2006, both of which applications are hereby incorporated by reference in their entirety.

FIELD OF THE INVENTION

The present invention relates to an improved computerized method and system for administering a universal rating of pocket billiard players. The invention also relates to a computer system which facilitates the use of player ratings for the classifying and handicapping of players in pocket billiards.

BACKGROUND

To rate a billiards player is to take a measure of his skill. To handicap a billiards player is to adjust the score of a game at its beginning in order to compensate for a perceived disparity in skill (so as to promote a competitive match). Rating billiards players is important and useful not only for the individual wishing to compare his skill with others and to measure his own improvement, but also for event organizers attempting to classify or handicap participants. Billiards is different from other sports and presents unique challenges for those attempting to rate and to handicap competitors.

Eight-ball (or 8-ball) is the most recognized and popular pocket billiards game in the world. It is an interactive game requiring two players or teams, and usually played for recreation or at the amateur level or in some pocket billiards leagues. Standard Eight-ball is played with 15 balls numbered 1 through 15. There are two groups of balls: numbered balls 1 through 7 which have an overall generally solid color (called "solids"), numbered balls 9 through 15 which have a stripe (called "stripes."), and the 8-ball which is solid black. The game is won by a person or team pocketing all the balls in one of the two groups and plus the 8-ball.

At the start of the game, all 15 balls are racked at the foot-spot of the table with the 8-ball in the middle, and 1 solid ball and 1 stripe ball on the corners. The remaining balls are racked at random. See FIG. 1. The player breaking the balls must pocket a ball on the break in order to be permitted to continue shooting. If a ball is not pocketed on the break, then the other person or team may shoot, and turns alternate until a ball is legally pocketed. The table is considered to be "open" so long as no ball has been pocketed legally after the break. Once a player legally pockets the first ball, the group (solids or stripes) to which that ball belongs becomes that player's or team's "choice group". The other player or team takes the other group. The first player or team to legally pocket all seven balls of their own group and then the 8-ball wins the game.

Nine-ball (or "9-ball") is played with 9 balls numbered 1 through 9. The object of the game is to be the first to legally pocket the 9-ball. At the start of the game, the balls are racked in a diamond shape with the 1-ball at the front, the 9-ball in the middle, and the rest placed at random. See FIG. 3. One player breaks the balls and may continue to shoot so long as they legally pocket a ball in each shot (including the break shot). In 9-ball, any ball that goes into a pocket is legal so long as the player hit the cue ball into the lowest numbered ball on the table first and the cue ball did not go into a pocket (called a "scratch") and the player did not otherwise foul. Thus, 9-ball is not a called shot game. Any time a player fails to legally pocket a ball, the opposing player shoots next and plays the table as the balls lay. If the player scratched, or fouled, the incoming player can place his cue ball anywhere on the table and begin his turn from that point.

Ten-ball is played with 10 balls numbered 1 through 10. At the start of the game, the balls are racked in a triangle shape with the 1-ball in the front, the 10-ball in the middle, and the rest placed at random. See FIG. 5. The game is played much like 9-ball, except the game is won when a player legally pockets the 10-ball at any time (including the break).

Score is generally kept in these games by recording a simple win or a loss. However, it is known to use a point system in 8-ball or 9-ball. In an 8-ball point system, each ball is worth 1 point and the 8-ball is worth 3 points (with a total of 10 points possible). In a 9-ball point system, odd numbered balls are worth 1 point and the 9-ball is worth an extra 6 points (with a total of 11 points possible). A range of various statistics may also be recorded, such as number of balls pocketed, errors, innings, points scored, shots taken, open shot opportunities, no shot opportunities, and number of times the 8-ball, 9-ball or 10-ball is made on the break.

Many ratings and measurement systems and methods exist for rating pocket billiard players playing on bar tables and regulation tables, and playing well-known billiard games such as Eight-ball, Nine-ball and Ten-ball. It is desirable to use a universal ratings system that measures and rates each player when they are performing at their best and is able to filter out play under adverse condition by taking into account a large number of consecutive events that provide the basis for the rating system for the particular billiard player. However, all known prior art pocket billiard player rating methods have at least one out of four disadvantages. These reasons are: 1) they do not use an uninfluenced statistic as the only rating component to score the game and to rate the player; 2) the billiards game must be altered from its universally recognized form; 3) the rating is not expressed in easily understood scoring increments; and 4) the player rating is not portable.

First, an influenced playing statistic should not be used as the rating component because the rating of a player could be influenced by the performance of his opponent. Because Eight-ball, Nine-ball, and Ten-ball are interactive games, in which players take turns trying to win each rack, all of these factors (balls pocketed, errors, wins, losses, etc.) are affected by the performance of a player's opponent. For this reason, all existing prior art rating systems based on the score of a game of Eight-ball, Nine-ball, and Ten-ball use an "influenced" number for rating component. In particular, it should be kept in mind that, in many leagues and other situations, it is the players themselves who are expected to keep track of the score. Players are frequently unpleased to record a compilation of statistics and regard it as burdensome and a nuisance. Players will also forget to record these kinds of statistics, and opponents are unlikely to ensure that the recorded statistics are accurate unless the statistics are related to the score. Thus, any prior art rating system for Eight-ball, Nine-ball, or Ten-ball which requires keeping track of the number of innings in a game or other statistics, have this disadvantage.

Secondly, the game that is used as the basis for the rating system should be universally recognized and substantially unaltered. Some players find it objectionable if a rating system causes them to play a new, previously unknown, game particularly if it is substantially different. In particular, the game should remain interactive, which means that the game must be played by two or more opponents who can affect one another's play in some way. In pocket billiards, this means that one player finishes his turn, leaving the balls in particular positions and then his opponent must begin his own turn with the balls in those same positions. Only interactive games are widely used in pocket billiards tournaments and leagues. Much effort has been spent attempting to introduce non-interactive, solo-scored games to the pocket billiards community. These games have never proven palatable and have never gained popularity. If a rating system is to be successful for Eight-ball, Nine-ball, and Ten-ball, the method of play must be interactive.

The rating designation should process the players' statistics so that a player's rating is expressed in easily understood scoring increments. If the generated player ratings are presented in a way easily related to the increments in which a player scores the game, then the meaning of the ratings is understandable to the player, and he or she can easily relate his performance in the game to the rating component that will determine his player rating. Were the player rating to contain other ratings such as "power points", percentages, win-loss averages, and skill levels, the relation between a player's performance in the game and their statistics would not be obvious to him or her.

Finally, the player rating should accurately measure and reflect the skill of a pocket billiard player while remaining portable. The rating must have significance outside of the pool of opponents within which a player typically plays. An important function of a player rating is that it provides a way to compare a player's skill with others outside of his immediate community, especially for the purposes of tournaments and leagues. This is particularly the case when the universal rating is used to handicap a pocket billiard player by, for example, adjusting the score of a match in order to compensate for disparity in skill (so as to promote a competitive match). The accurate rating of players is important and useful not only for the individual wishing to compare his skill with others and to measure his own improvement, but also for event organizers attempting to classify or handicap participants.

BRIEF SUMMARY

Pocket billiards lacks a universally accepted, successful rating system overcoming the disadvantages mentioned above. The preferred embodiments of the invention use a new rating component and a new method of scoring and playing Eight-ball, Nine-ball, and Ten-ball, including a computer-implemented rating system with a database to overcome the disadvantages of the prior art. The preferred embodiments provide a portable, accurate player rating system that can be used for classifying and handicapping billiard players, along with an implementation to ensure its success and acceptance.

The preferred embodiments utilize a new rating component for Eight-ball, Nine-ball, and Ten-ball that is uninfluenced, that makes the recording of the rating statistics simple, and without requiring the player to expend additional effort to record additional statistics. The preferred embodiments provide a rating system for the universally recognized games of Eight-ball, Nine-ball, and Ten-ball and do not seek to create a new, previously unknown game. The preferred embodiment also introduce a method of scoring interactive games of Eight-ball, Nine-ball, and Ten-ball in which the scoring increment is balls and the rating component is balls, making the rating designation that is also in balls, easily understood.

The preferred embodiments introduce a new method of playing and scoring billiards games while simultaneously generating statistics for a player rating system. More specifically, they organize statistics and perform calculations resulting in portable player ratings that can be used for classifying and handicapping pocket-billiards players of widely different skill levels. Game data for players is entered into a computer system and stored in a data base.

In order to more completely understand the universal ratings system of the present invention, it is essential to understand the following terminological definitions:

Break count: the number of object balls remaining on the table at the conclusion of the break inning.

Scored break: a break that is counted toward a player's average and rating (preferably, a break is not a scored break unless a ball is made on the break shot).

Current average: the average calculated from a player's 100 most recent scored breaks. This average is the break count divided by the number of consecutive scored breaks. A minimum of 10 scored breaks is required to be considered a current average. A current average can be either a partial average or a full average.

Partial average: an average where a player has between 10 and 99 scored breaks.

Full average: an average of precisely 100 consecutive scored breaks.

Best average: the average that is determined to be either a player's best full average using scored breaks from the most recent three years or if a player has a partial average, then the player's current average becomes the player's best average.

Division: a name or letter designation in place of the first number in a player's best average.

Level: the second number in a player's average, a number between 0-9, designating level within a division.

Rating: a player's best average interpreted into a division and level. A rating can be either a partial rating or a full rating.

Partial rating: the rating obtained where a player has between 10 and 199 scored breaks.

Full rating: a rating where a player has a minimum of 200 scored breaks.

Player status: the determination that results from a player's rating reviewed and validated by a rating committee.

Certified status (C): the status fully earned by a player through recording break counts. The player must have at least 200 scored breaks in the most recent three years. The rating committee must agree with the player's best average. A player with certified status has/his rating listed on the rating list.

Provisional status (P): a temporary status that is earned by a player through recording break counts. The player must have between 10 and 199 scored breaks in the most recent three years. The rating committee must agree with the player's best average. A player with provisional status has his or her rating listed on the rating list.

Designated status (D): a temporary status for a player that must have between 1 and 199 scored breaks in the most recent three years. The rating committee must disagree with the player's best average. The rating committee assigns an estimated fair rating. The player competes with this rating in the league and where permitted. A player with a designated status will not have his or her rating listed on the rating list.

Invalid status (I): a dubious status with negative consequences. A player can have any number of scored breaks. The rating committee must disagree with the player's best average. The rating committee assigns an estimated fair rating. The player is only allowed to compete with this rating in the league. A player with invalid status will not have his or her rating listed on the rating list.

DETAILED DESCRIPTION OF THE PREFERRED EMBODIMENTS

Each of the preferred embodiments of the invention utilize a computer system with the functionality as described below, either as the single, sole, purpose of the computer or as the result of a software program that causes the computer to function as here described. The computer systems of the preferred embodiments provide ratings for a plurality of billiards players for different billiards games and different table sizes. They can calculate a player's rating immediately, accurately, and efficiently, for the purposes of educating the player, encouraging fairer competition, and creating new and additional interest in pocket billiards. Although the preferred embodiments are described for the following three popular billiard games: Eight-ball, Nine-ball, and Ten-ball, they can be used to rate the skill of players for numerous pocket billiard games.

The computer systems in the preferred embodiments of the invention utilize one measurement of performance in a game, the break, that includes almost all of the player's relevant abilities. The break is an identical condition for all players; and this condition is then isolated and measured. The universal ratings system is made simple enough for understanding by any pocket billiard player. Thus, the player's performance is measured numerically, and this number represents a direct quantitive correlation to a player's ability. Each player accumulates multiple performances from which an average is developed with the player's best average used to determine his or her rating. Among the uses and advantages of developing a player rating from the break of a given pocket billiard game is that accurately rated players can participate in various types of events and activities with other players at the commensurate rating; rated players can participate in team events where no handicap is required; and the numerical averages are used to develop handicaps between players of different abilities. The break of the billiard balls is the single repeatable condition that is identical for all players. Most of a player's billiard playing ability can be summarized and quantified by measuring multiple performances of the break inning.

Figure 20:
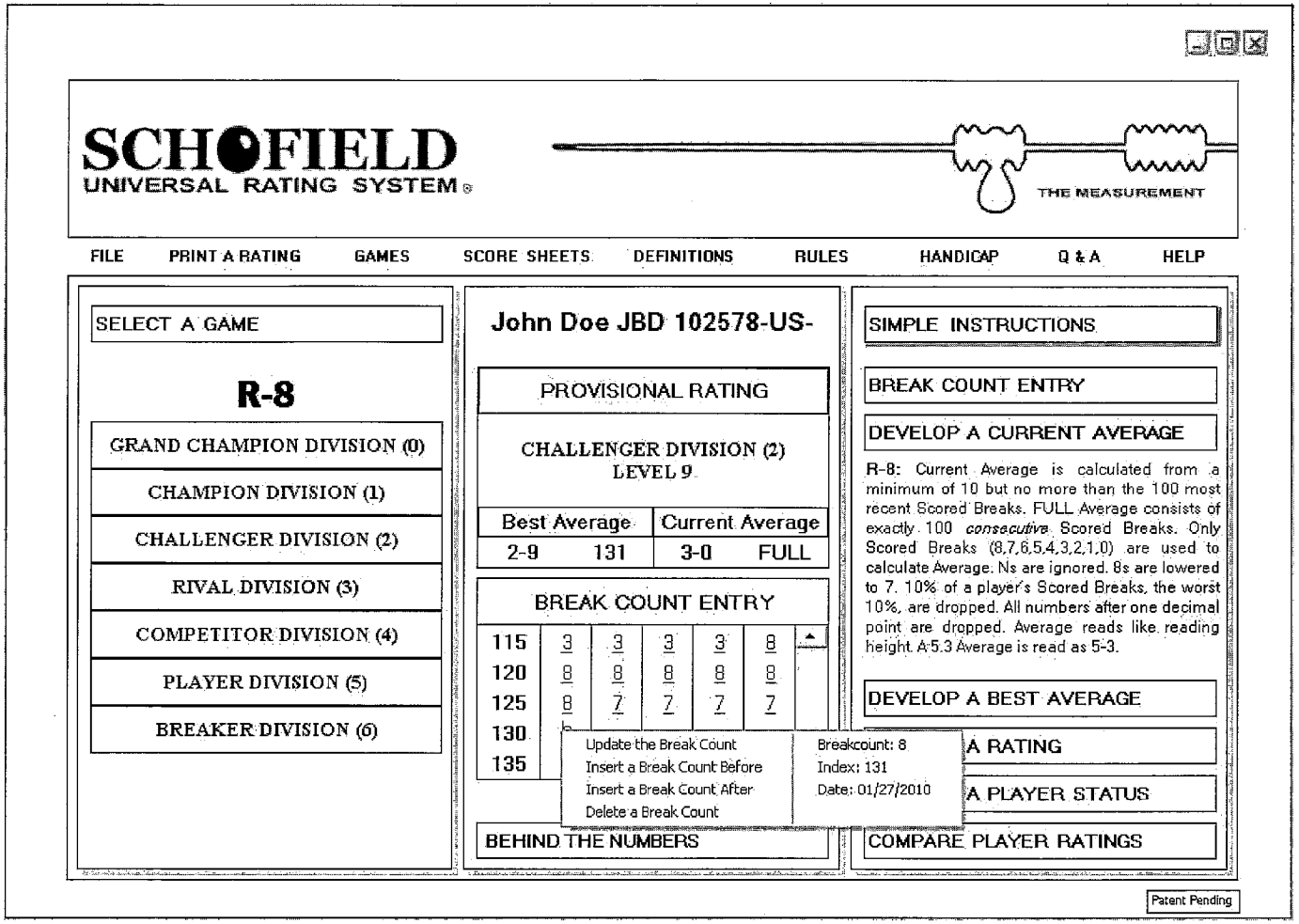

The precise measurement for determining the player rating is how close he or she gets to running out the rack in his or her break inning. At the conclusion of the break inning, a count is made of the billiard balls remaining on the table, and this count is recorded. The break count is the number of billiard (object) balls remaining on the table at the conclusion of a break inning. The lower the break count, the better the performance. As an example, a break count of five means that at the conclusion of the break inning, the player was five balls away from running the rack in the break inning. (Conversely, some embodiments of the invention could count the number of balls pocketed in the break inning instead of the number of balls remaining after the break inning. However, counting the billiard (object) balls left on the table has four primary advantages: 1) it is easier for the player to count the billiard (object) balls in front of him or her; 2) the measurement is in direct relation to the winning ball; 3) the desired break count is the same (zero) for all games; and 4) it supports a numeric standings ladder such that as shown in FIG. 20 and other figures, there are divisions where 1 is better than 2, 2 is better than 3, and so on.

Figure 1:
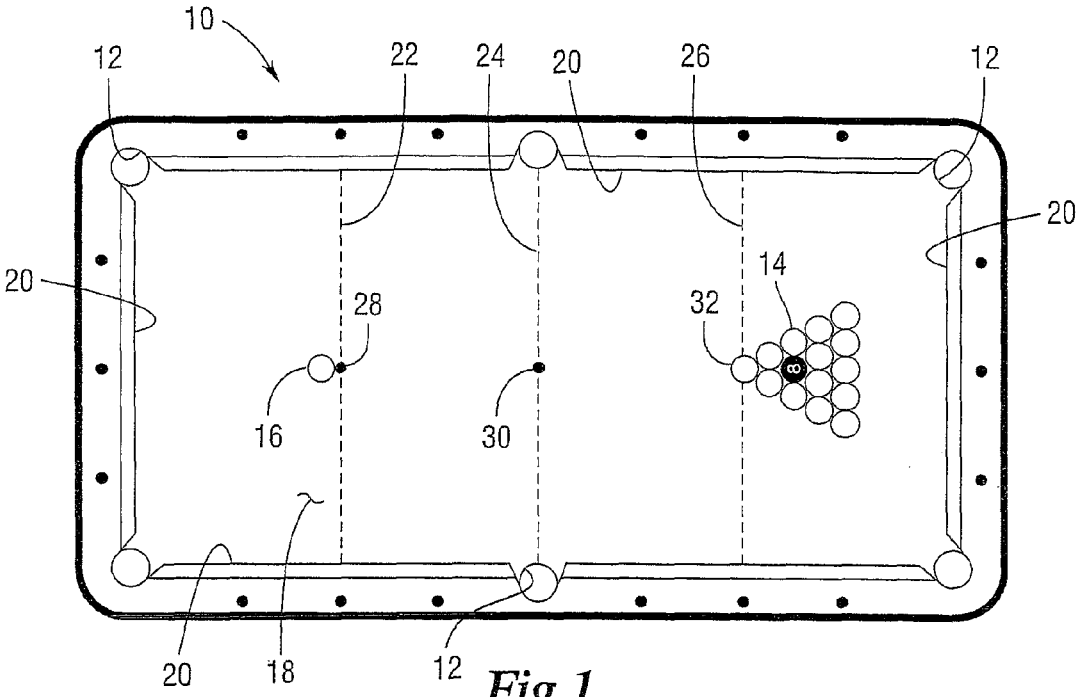
FIG. 1 is an illustration of the arrangement of billiard balls on a billiard table for a game of Eight-ball prior to the break.
Figure 2:
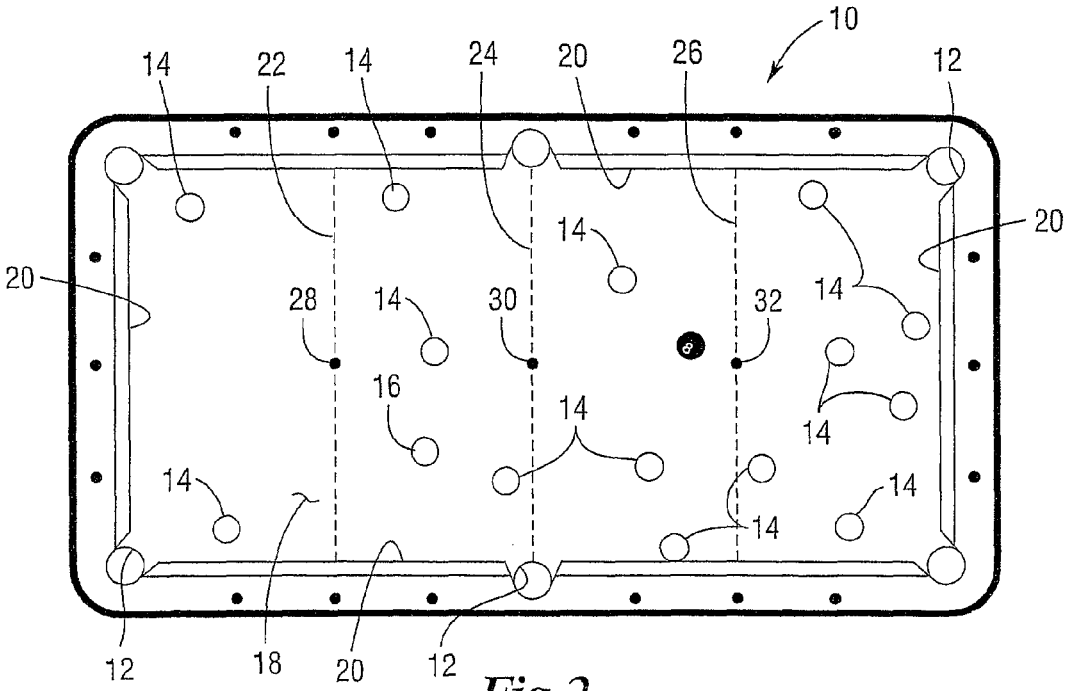
FIG. 2 is an illustration of a distribution of balls about the table surface, in which a number of billiard balls have been pocketed, at a conclusion of a representative break inning in a game of Eight-ball.
Figure 3:
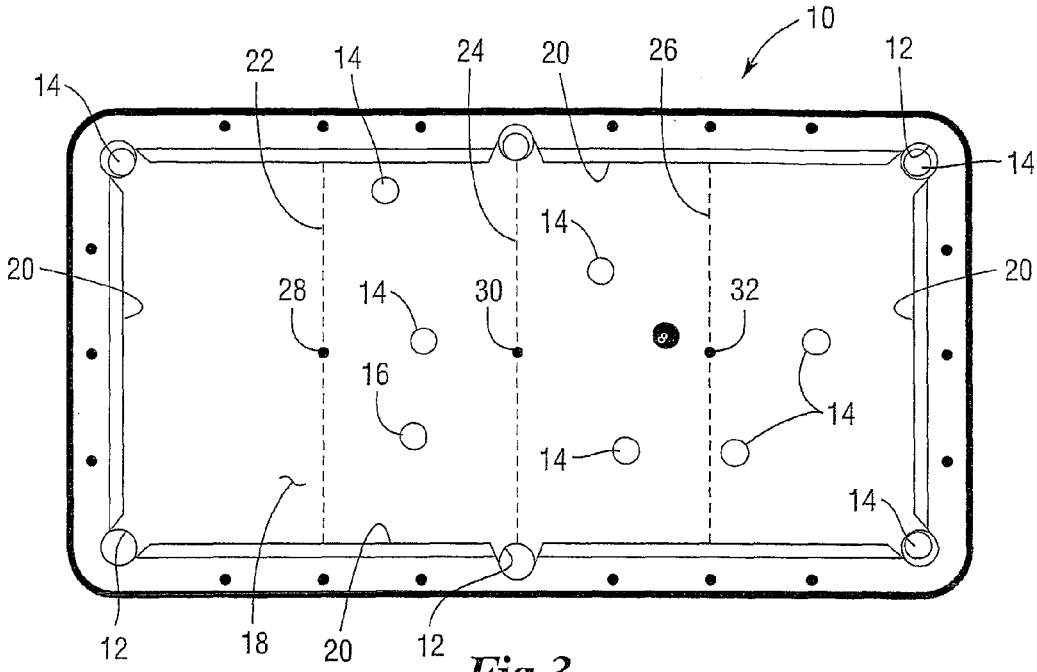
FIG. 3 is an illustration of the arrangement of billiard balls on a billiard table for a game of Nine-ball prior to the break.
Figure 4:
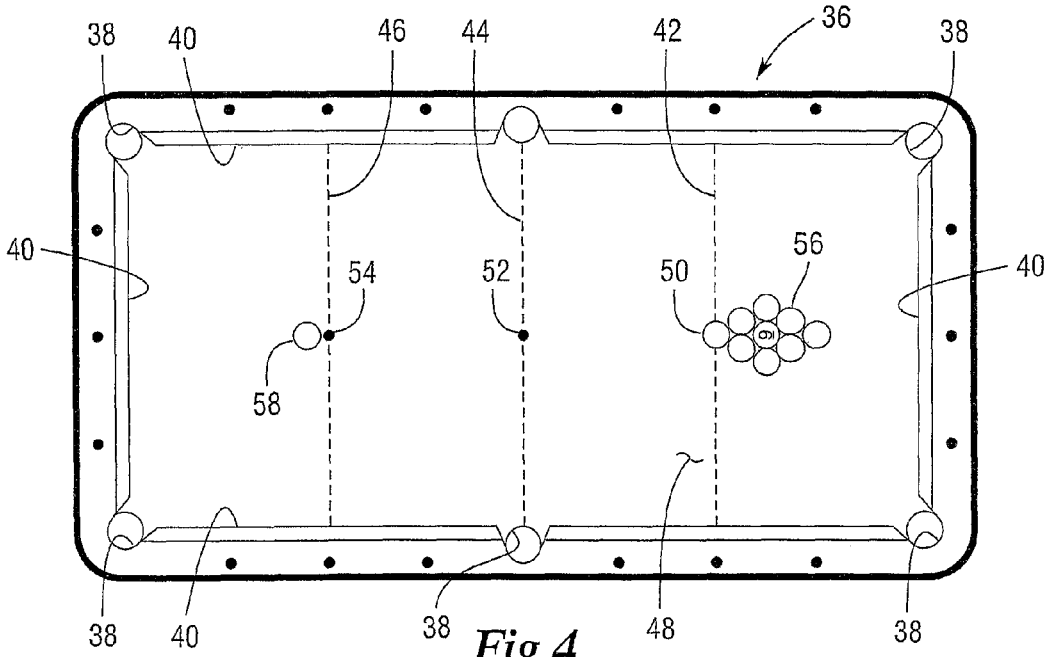
FIG. 4 is an illustration of a distribution of balls about the table surface, in which a number of billiard balls have been pocketed, at a conclusion of a representative break inning in a game of Nine-ball.
Figure 5:
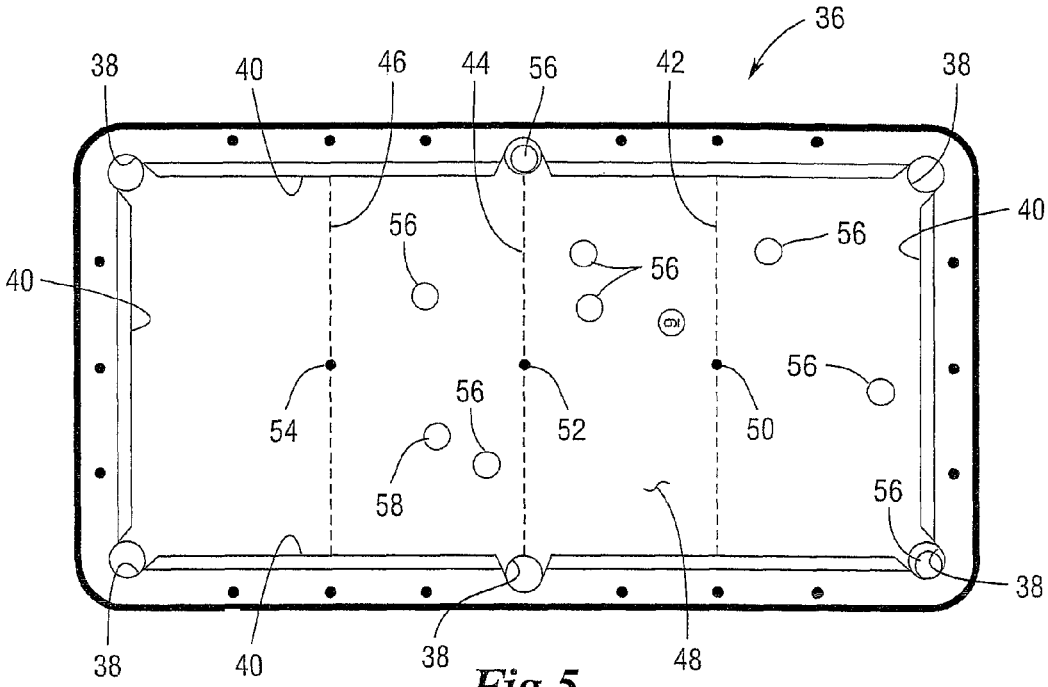
FIG. 5 is an illustration of the arrangement of billiard balls on a billiard table for a game of Ten-ball prior to the break.
Figure 6:
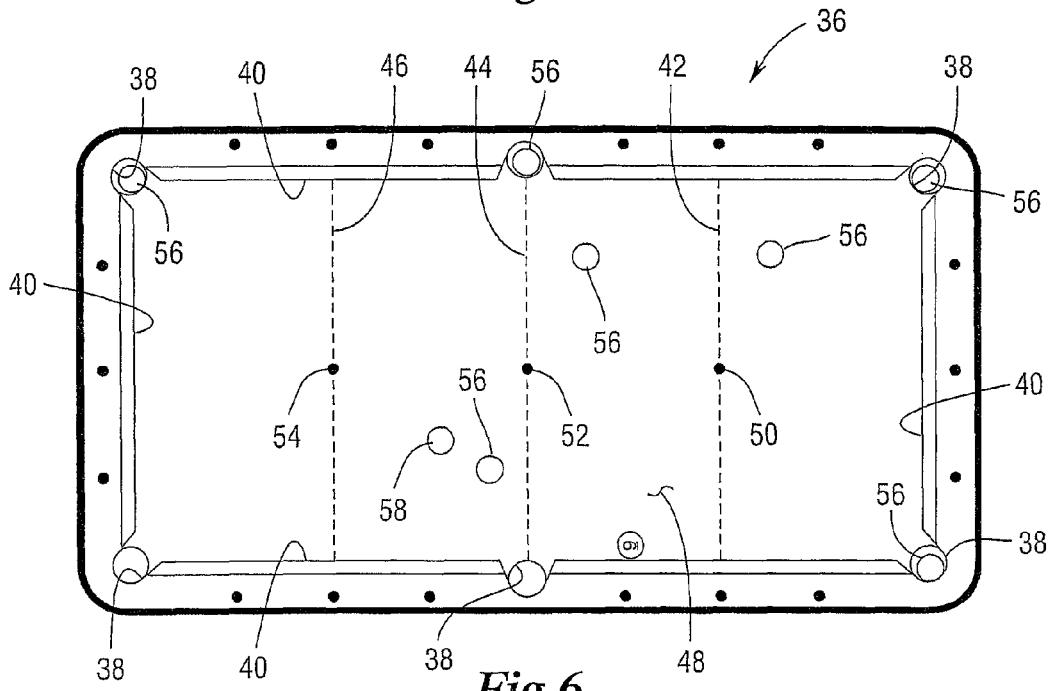
FIG. 6 is an illustration of a distribution of balls about the table surface, in which a number of billiard balls have been pocketed, at a conclusion of a representative break inning in a game of Ten-ball.
Figure 7:
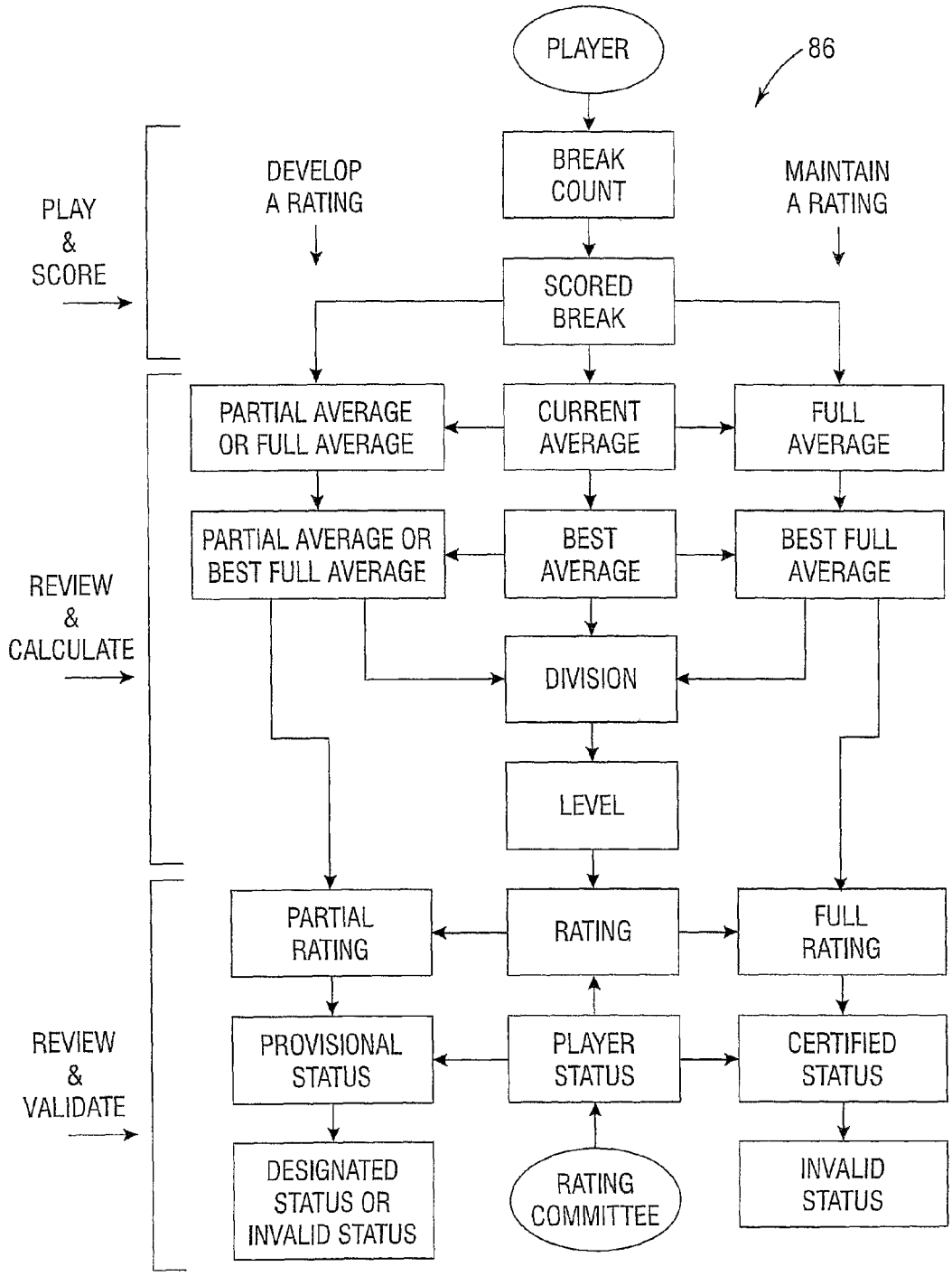
FIG. 7 is the flowchart of a universal rating method for a preferred embodiment of the present invention.

One of the main functions of the computer systems in the preferred embodiments is to generate and store a rating for each player by applying a formula, rules and algorithms to the player's break counts entered in the system. With reference to the table below and the flow chart 86 set forth in FIG. 7, the following formula, rules and algorithms are preferred for developing a player rating for each of the above-described games (Eight-ball, Nine-ball, and Ten-ball) played on two standard table sizes, for a total of six possible ratings.

The computer systems preferably utilize a combination of variables which allow the rating to be adjusted. These variables include: 1) the number of Break Counts considered to be a full sample (e.g., 100 break counts); 2) the percentage of Break Counts dropped (e.g. 20%); and 3) the time period for which break counts can be applied (e.g., three years). The variables can be changed by an administrator of the computer system and may be, but need not be, set differently for each combination of game and table type. The variables cannot be changed by an individual user and must be applied to all players for which the player ratings are expected to work as universal ratings.

As a first rule, only scored breaks count toward an average. An average consists of a minimum of 10, and up to but not more than a designated number (X) of consecutive scored breaks. A designated percentage (Y %) of scored breaks are dropped as follows: determine the number of consecutive scored breaks to be averaged; keeping in mind that the maximum number allowable is X. Then determine how many scored breaks comprise Y % of the total scored breaks to be averaged by multiplying Y times the number of scored breaks. If Y % includes a fraction of a scored break, drop the fraction. The number remaining is the number of scored breaks to be identified and dropped before the average is calculated. Then identify and drop the worst (highest numbered) scored breaks up to Y %. Then total up the billiard ball count of all remaining break counts and divide that number by the number of break counts used to determine the ball count total. The average that results is truncated to one decimal point, and a dash replaces the decimal point. The average thus reads like a height reading: for example, 3.4 becomes 3-4, and 4.7 becomes 4-7.

| SELECT GAME | | PER-CENT (Y) | NUMBER OF SCORED BREAKS (X) |
|---|---|---|---|
| REGULATION-TABLE EIGHT-BALL | R-8 | 10 | 100 |
| BAR-TABLE EIGHT-BALL | B-8 | 10 | 100 |
| REGULATION-TABLE NINE-BALL | R-9 | 20 | 100 |
| BAR-TABLE NINE-BALL | B-9 | 20 | 100 |
| REGULATION-TABLE TEN-BALL | R-10 | 30 | 100 |
| BAR-TABLE TEN-BALL | B-10 | 30 | 100 |

The current average is calculated from a player's most recent (X) consecutive scored breaks. If a player has less than (X) scored breaks recorded, then a partial average becomes the current average. Partial average consists of the entire player's scored breaks where the player has only recorded from 10 to (X−1) scored breaks. Full average consists of (X) consecutive scored breaks.

In addition to implementing the rating system, a primary function of the computer system is to prompt or otherwise facilitate the entry of break counts for a player's matches. There is some mechanism which enables the billiard game and table size to be identified for each match. The break counts may be entered in a variety of ways in different embodiments and may be moved and organized in a variety of ways. For example, the computer program may enable the break counts to be moved to a history by a user.

The computer program enables score sheets to be printed for each game (Eight-ball, Nine-Ball and Ten-Ball) and for each variation of the game, either standard play, or Scored Play or Match Play as described later in this patent application. The computer program also enables a new average report, a player summary report and date activity report to be obtained and printed for each player. The new average report has the best average and the number of breaks on which it is based, and the current average and the number of breaks on which it is based. The summary report includes the player's average, the number of break counts considered, the divisionalization of the player, the ball on the break percentage, and the nm-out percentage. The date activity report includes the dates on which the player played matches. It may or may not include the number of break counts recorded on that day. The computer program permits a history report to be obtained and printed for a player which includes the player's average, best average, number of breaks, ball on the break percentage, run-out percentage and dates. The player history report is not limited to these categories and may include additional categories, such as who was played in each match, etc. Preferably, all reports can be modified to enable the user to design the report, such as the variables that can be plugged in and used, etc.

The computer program also includes a number of utilities, which are not directly part of the implementation of the rating system but which facilitate the use of the computer program. These utilities may include various documentation, such as the rules of the game, an explanation of the rating system or the official rules of the games, etc. These utilities may enable certain aspects of the program design to be utilized or not at the option of the user, such as the layout and theme of the user interface, etc. In one particular option, the computer program enables different colors to be used for different divisions of player skill level. For example, if a player reaches the gold division, the user interface could consist of gold colors.

Figure 8:
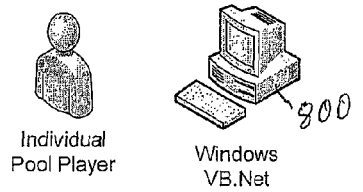
FIG. 8 is the architecture diagram of a stand-alone universal rating system according to a first embodiment of the invention.
Figure 11:
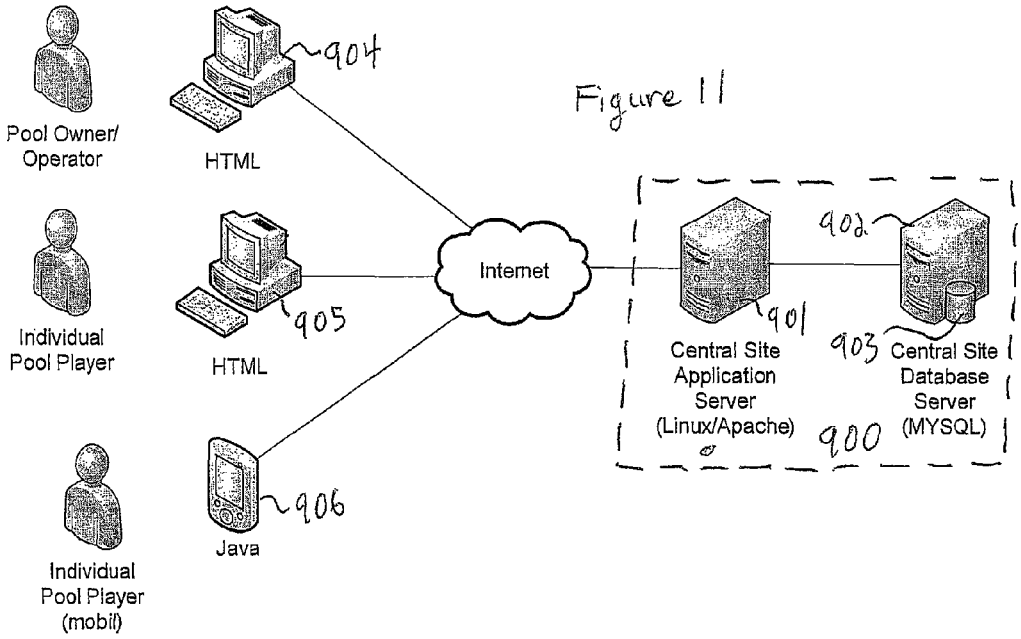
FIG. 11 is the architecture diagram of a distributed universal rating system according to a second embodiment of the invention.
Figure 9:
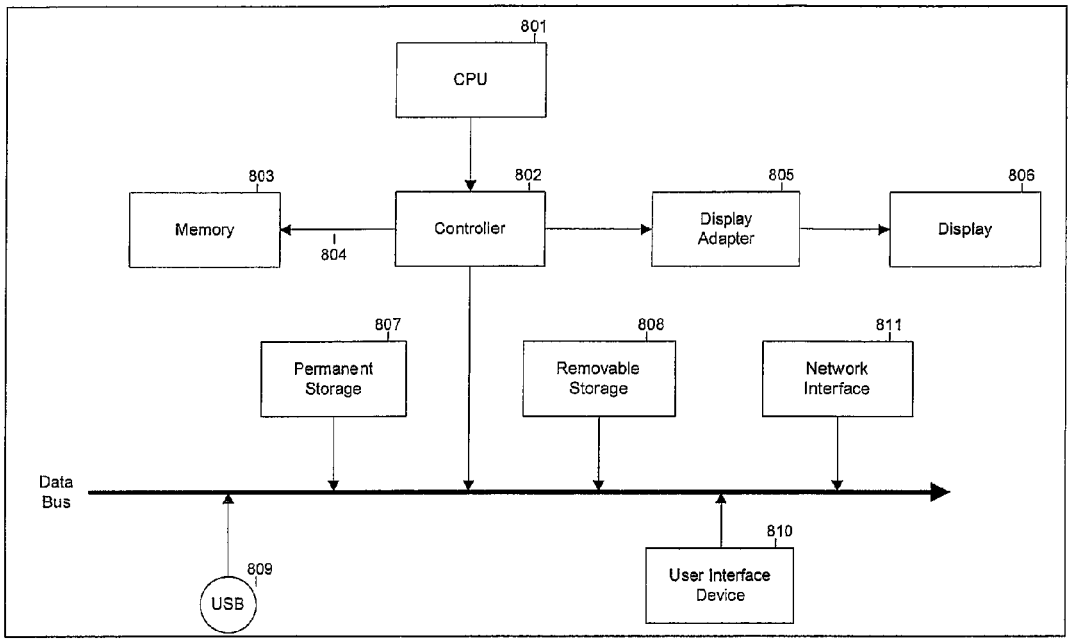
FIG. 9 is the block diagram of the exemplary structure of a computing device in the preferred embodiments of the invention.

FIGS. 8 and 11 illustrate two preferred embodiments of the invention. FIG. 8 shows a preferred embodiment in which an individual pool player (or pool owner/operator or pool league operator) operates a computer program installed on a standalone computer 800. An exemplary computer 800 shown in FIG. 9 includes a CPU (Central Processing Unit) 801 which executes operations according to the computer program; a main memory 803 connected to the CPU 901 via a controller 802 (which may be, for example, a chipset) and a memory bus 804; a display adapter 804 (which may be, for example, a discrete video card) which controls display 805 and is connected to the CPU 801 via the controller 802 and an display interface (which may be, for example, an AGP interface or a PCI-X interface). The controller 802 interfaces with a data bus 806 which provides data to and from a variety of components. These components may include a permanent storage device 807 (which may be, for example, a hard disk drive or a solid state drive); a removable storage device 808 (which may be, for example, an optical disk drive or a memory card reader). Data bus 806 may also support a Universal Serial Bus (USB) port 809 which enables the input and output of a variety of data over a standardized connector and other types of user input device 810 such as a keyboard or mouse. There is also a network interface 811 which connects the computer 800 to an external network, such as an Ethernet network or a wireless network. Of course, the bus structure and other physical details of computer 800 are merely exemplary and computer 800 may have a different specific implementation. In the preferred embodiment of the invention shown in FIG. 8, the computer program is written using Visual Basic .NET (VB.Net), a high level computer programming language. VB.Net is implemented on the .NET framework provided by Microsoft Corporation of Redmond, Wash. The .NET Framework is software that can be installed on computers running the Windows operating system of Microsoft Corporation. Therefore, any computer capable of running Windows and the .NET framework may be utilized in the preferred embodiment. In other embodiments of the invention, the computer program may utilize any one of a variety of different programming languages which may have different dependencies in terms of the operating system or the software framework. The .Net framework allows any Microsoft Windows based general purpose computer to have the specific functionality described herein without having to provide computer programming for specific hardware differences that exist in the computers offered by various component manufacturers. VB.Net provides a common, generic view of the computer machine abstracted from the hardware so that the programmer can focus on the specific purpose and functionality of the computer without having to know or understand the detailed hardware commands such as reading and writing to the various types of storage drives 807 and 808. Without the .Net framework or equivalent framework, each specific application on the computer would need to be individually programmed for every possible type of hardware and hardware manufacturer. The .Net framework provides the code for communicating to every usable hardware device through device drivers provided by the manufacturer or included in the Windows operating system so that each application need only utilize the common .Net commands.

In this way, computer 800 is made to operate and function in the specific manner described below when the computer program of the preferred embodiment is executed, although computer 800 also has the capability to execute other programs as well. Alternatively, a computing device can be made to operate in a "kiosk" mode so that a user interacting with the program cannot use the computer for any other reason. This permits, for example, a billiards owner/operator to selectively permit billiards players and other persons to use the computer solely in the manner described herein even though the computer is sometimes used for different purposes.

The .Net framework includes a large class library of programs for a large range of features for such common computer tasks as retrieving input from the input device 810, data and data access (e.g., reading and writing to storage devices 807 and 808), displaying output such as text and graphic on to display 805, database connectivity, cryptography, web application development, numeric algorithms, and network communications. It also creates a virtual machine that manages the execution of VB.Net computer programs by CPU 801 and memory 803. According to the preferred embodiment, an additional VB.Net computer program is provided, which in combination with the class library of the .NET framework functions as described below from the perspective of a user of the computer. The computer program executes in a software environment that manages the program's runtime requirements, known as the Common Language Runtime (CLR), which provides important services such as security, memory management, and exception handling. Because the CLR provides the appearance of an application virtual machine to the VB/Net computer program, the computer 800 can be programmed without specific knowledge of the specific CPU 801 (or any of the other details) in computer 800 that will execute the program. The computer program may be stored in permanent storage 807 or may be provided in a tangible storage medium readable by removable storage device 808.

Figure 10:
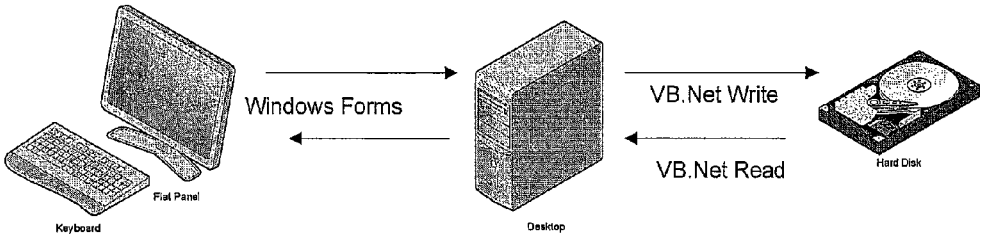
FIG. 10 is an illustration of the data processing in the first preferred embodiment of the invention.
Figure 12:
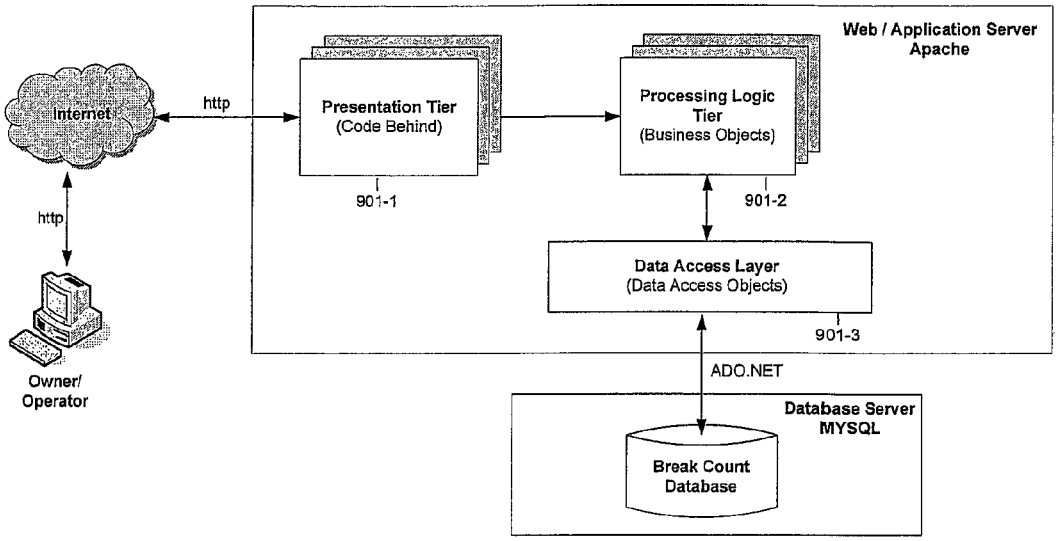
FIG. 12 is a block diagram showing details of the central site 900 in the second embodiment of the invention.

As known in the art, during execution of the computer program, various instructions and data will be written to and read from memory 803, processed by CPU 801 and an appropriate display provided on display 805. As shown in FIG. 10, the VB.Net computer program uses VB.net Windows Forms to obtain data from the user, processes the information according to the specialized instructions of the program, and provides the transformed information back to the user's screen using Windows forms. The user can save or retrieve the information using the VB.Net input/output commands. The computer 800 preferably saves the information for one player to storage device 807 in a sequential flat file format with all of the data stored as one long concatenated set of characters which can be written or read with a single command or action. The computer 800 can store information for multiple players in different respective files, without the ability to combine, compare or contrast information from the various players. Since the player information is stored in separate files, the computer 800 can also work with only one player at any given time.

FIG. 11 shows a preferred embodiment of the invention in which a computer system is implemented at a central site 900 to receive, store and process information relevant to billiards player rating, and to provide interaction with a plurality of different billiards playing venues. The central site 900 provides system users with player ratings and handicaps at a moment's notice. This is valuable for any player, venue operator, tournament promoter, or league operator looking to assess and compare the ability of various billiards players. Registered users have access to central site 900, either to provide information or to access information such as a player's rating.

The central site 900 includes an application server 901 and a database server 902 with an accompanying database 903. The database server 902 operates in a known manner to save a large amount of data in database 903 utilizing a relational database management system, such as MySQL. Application server 901 interacts with database server 902 and with a plurality of computing devices 904 to 906 at different locations via a distributed communications network, such as the Internet.

Although only three computing devices 904 to 906 are shown in FIG. 11, the system can accommodate different quantities of computing devices. One or more of the computing devices can be a typical computer 800 as described with respect to the preferred embodiment shown in FIG. 8. However, the computing devices 904 to 906 do not execute any customized software to cause them to perform as described therein. Instead, the customized software program is installed and executed in application server 901 and is preferably logically divided into three broad categories or tiers. The Presentation Tier 901-1 is specifically programmed to manage the communication of web pages or other Hyper-text Markup Language (html) document to and from the terminal over a Hyper-text Transfer Protocol (http). Communication to and from the computer devices 904 to 906 includes actions such as capturing any interaction by the user with the computer terminal and its input device(s) and transmitting the results of the computations performed in the Processing Logic Tier 901-2 back to the terminal for display.

The Processing Logic Tier 901-2 contains the algorithms needed to implement the universal rating system according to the invention. The Processing Logic Tier 901-2 receives end user input from the Presentation Tier and performs the necessary calculations to provide the billiards player with a rating and ranking. The Processing Logic Tier 901-2 contains common program code that is sharable and reusable across multiple functions within the application server 901. The Processing Logic Tier 901-2 also communicates with the Data Access Layer 901-3 to retrieve and store information into a central database managed by a Database Management System (DBMS). This embodiment preferably uses a relational Data Base Management System which contains billiard rating information for all of the players in one location, instead of the flat file storage system of the previous stand-alone computer embodiment which contains only one player's information in a single file.

The Data Access Layer 901-3 contains common sharable programming code containing Structured Query Language (SQL) statements specifically programmed for use and reuse across the application server 901. The Data Access Layer 901-3 may utilize ADO.NET framework from Microsoft Corporation for connecting and communicating to the actual database. The Break Count Database is preferably designed and programmed to store the required information in a specified structure that supports the functionality of the central site application.

Figure 13:
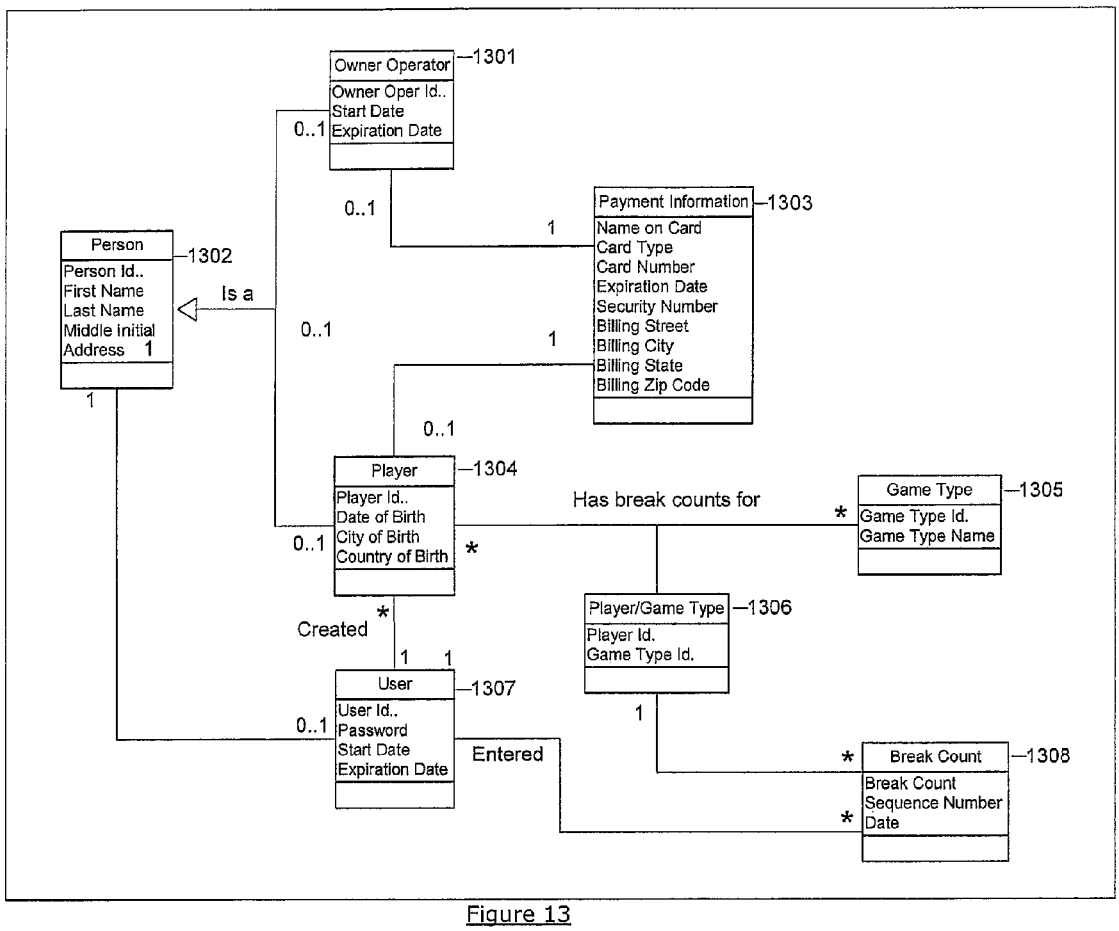
FIG. 13 is a UML diagram of the preferred data structure of database 903 in the second embodiment of the invention.

FIG. 13 is a Unified Modeling Language (UML) Class diagram which reflects the logical and permanent structure of the data which is used in the database in central site 900 as previously described. This diagram does not show data flow, but instead shows the static, unchanging, relationship between groups of information in accordance with standard nomenclature know to those in the art of software engineering.

Classes represent a pattern or type of data that can be logically grouped together. The attributes of the class list the actual information that is to be stored for the specified class. Classes can be related to other classes.

The relationship between classes is documented by the lines connecting the classes. In the UML, these lines are known as associations. These lines describe and document the business relationship between the various groupings (classes) of information. The association relationship indicates that (at least) one of the two related classes makes reference to the other. The notation at the end of each line indicates the number of instances of that entity (the number of objects that participate in the association). The first number at the end of an association indicates the minimum number of instances required while the second number indicates the maximum number of instances allowed.

The database 903 is uniquely designed to capture, store, and relate all of the information needed by the billiards player rating system. in the example data structure of FIG. 13, g the system's classes are represented by class graphics 1301-1308 and their attributes or data elements are indicated in the second compartment in the class graphic, and the relationships between the classes are indicated by the lines between the classes 1301-1308.

In the example of FIG. 13, the Person class 1302 includes all of the information about a person that would be relevant to the billiard player rating system and stores it in a Person database table. The attributes for the Person class 1302 are: Person Identifier, First Name, Last Name, and Middle Initial. In FIG. 13, a "0..1" indicates that there may be no instances related or that at most only one instance may be related; a "1" which is a short form for 1..1, indicates that a minimum of one must be related and that no more than one instance can be related; a "0..*" or "*" indicates that there may be no or zero instances related and that there could be many instances related; and "1..*" indicates at least one must be related and that there could be many instances related. Once a person has been entered into the system, they could perform the following combination of roles (as defined by the "IS A" relationship):

- OWNER OPERATOR 1301—a person who owns a billiard establishment but does not participate in maintaining a billiard rating
- PLAYER 1304—a person with related billiard rating information
- OWNER OPERATOR and PLAYER—the person who owns a billiard establishment and has related billiard rating information The arrowhead on the line to person class 1302 indicates a specialization of person class 1302. This specific relationship defines the role that a person is performing within the system and is read as "A Person 1302 IS A Owner Operator". When a person performs a specific role, the system requires that additional information be captured. For example, when a person performs the role of an Owner Operator 1301, additional information is needed which is stored within an Owner Operator Database Table. As stated in the list above, a person may perform the role of a single Owner Operator, they may perform the role of a player, or they may perform both roles. Each of the roles has specific functions available within the system. Therefore, for security and functional privileges, the computer system must keep track of the roles assigned to each of the individuals (defined by the "IS A" relationship).

A person 1302 may be given access to the system by providing them with a User Account USER 1307 which will be used to authenticate the person to the computer system through a unique identifier and password. This relationship is documented by the line between Person 1302 and User 1307. The User who created the Player is also stored which is demonstrated by the line between User 1307 and Player 1304

The computer system stores one or more break counts 1308 for each player and game type combination PLAYER/GAME TYPE 1306. For example, break counts can be stored for the player/game type combination of John Doe (player) and regulation Nine-ball (game type). Each player and game type combination will have a separate set of break counts associated with it. The User who entered the break counts is also captured as indicated by the line between User 1307 and Break Count 1308

Payment information 1303 is also maintained for each of the two roles. This allows the person to pay from different accounts for the two different roles. For example, an owner operator might want to pay from a business account, but pay for his own individual player rating pay from a personal account.

The application server 901 also includes a web server, such as an Apache HTTP web server, that serves the HTML web pages to computing devices 904 to 906. Therefore, although any of the computing devices 904 to 906 may be computers as described above with reference to FIG. 11, the only necessary functions are that they have a web browser which is able to receive and display HTML web pages, and permits the user of the device to interact with the web page. Thus, any of the computing devices, such as computing device 906 shown in FIG. 11, can be a small, mobile, handheld device such as a cell phone that communicates wirelessly via a wireless network or an Internet appliance. Furthermore, the computing device need not be a standalone computer but it could be integrated or associated with a billiards table. Since the only necessary functions of the device are that it has a web browser which is able to receive and display HTML web pages, and permits the user of the device to interact with the web page, the computing device can be quite small.

Although FIG. 11 depicts the Internet and the connections rather simply, it should be understood that there may be a wide variety of communications, the detailed nature of which does not matter so long as it can communicate the HTML web pages between application server 901 and the computing devices 904 to 906. The system in the preferred embodiment of FIG. 11 may include various security mechanisms to authenticate the users connected to central site 900.

An exemplary user interface in the preferred embodiments of the invention will now be described by reference to FIGS. 14-35. Although a single user interface is shown, it should be understood that there may be slight differences between the user interfaces provided in different computer systems.

Figure 14:
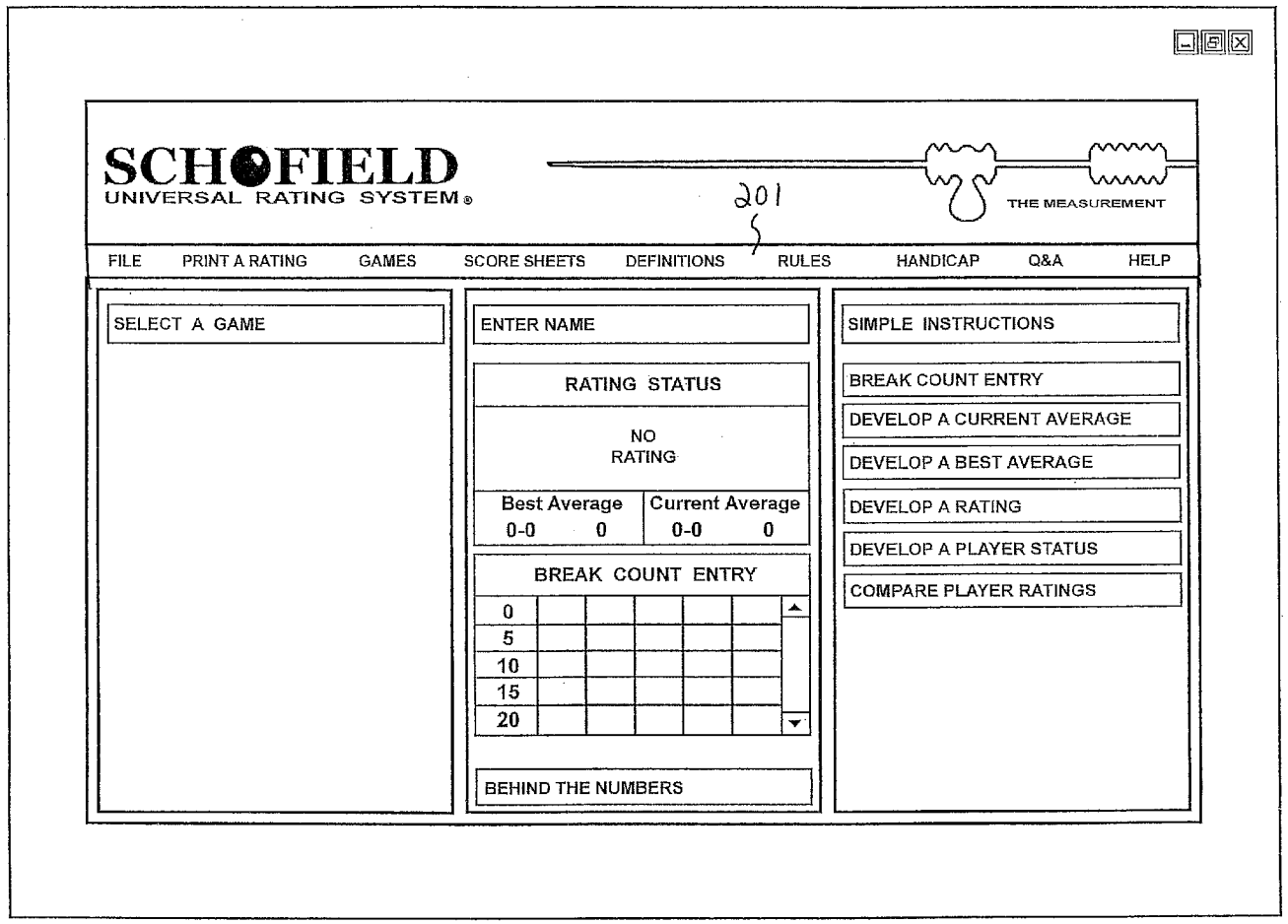
FIG. 14 is the main user interface provided by the computer system according to a preferred embodiment of the invention.
Figure 15:
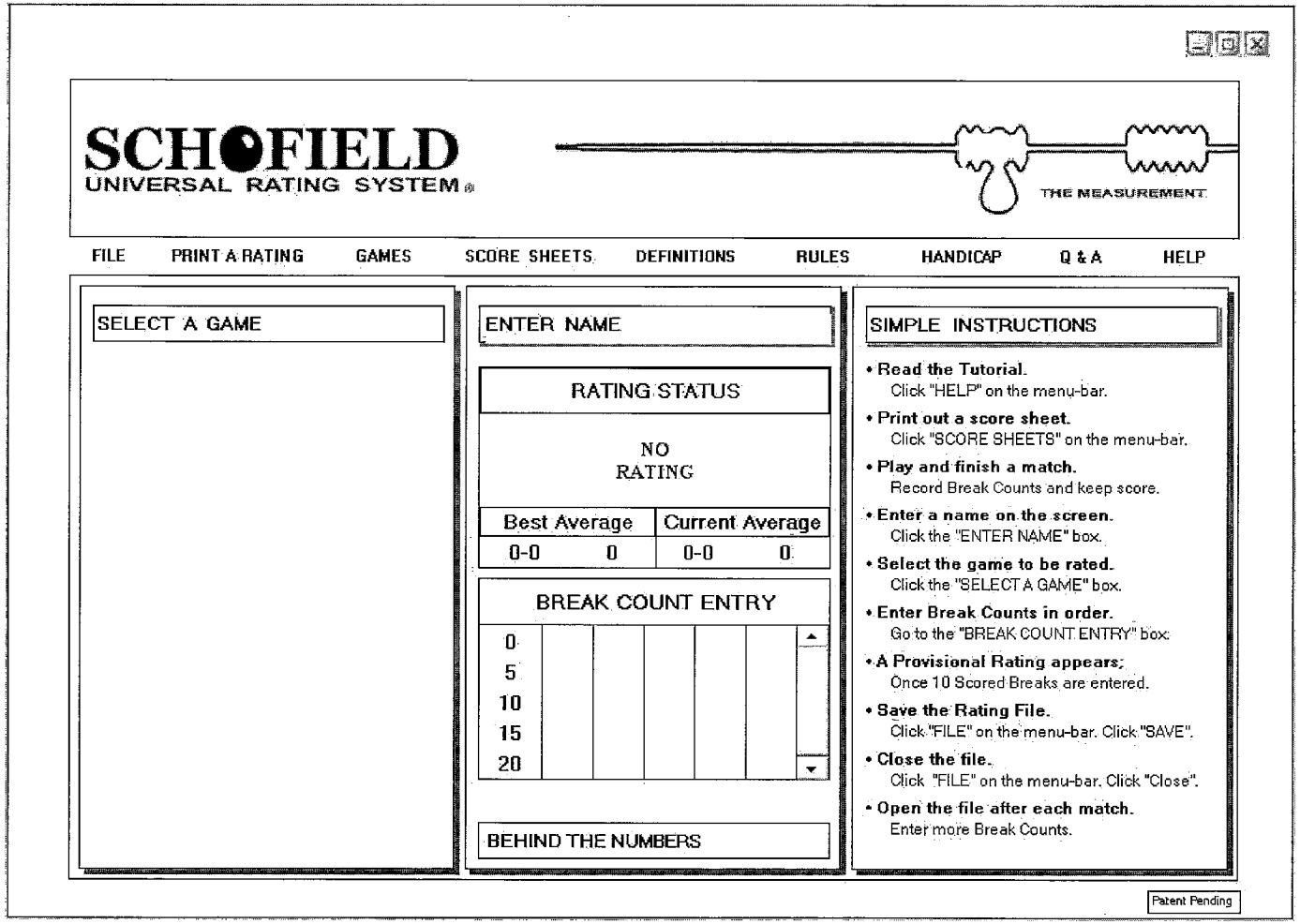
FIGS. 15-35 are various user interfaces provided by the computer system in response to user interaction of the main user interface shown in FIG. 14.

The opening screen of the computer is shown in FIG. 14. It has a horizontal menu bar 201 across the top which presents various options. There are options for "File", "Print a Rating", "Games", "Score Sheets," "Definitions," "Rules," "Handicap," "Q & A", and Help." The options can be identified by text as in the figure or buy suitable icons. A left-hand column below the menu bar has a button for "Select a Game." The middle column menu includes a "Player Name" area, a "Rating Status," a "Rating interpretation," "Best Average and number of breaks," "Current Average and number of breaks," a "Break count entry area," a "Results area" and "Behind the Numbers." A right hand column below the menu bar includes "Simple Instructions," "Break count Entry," "Develop a Current Average," "Develop a Best Average" "Develop a Rating," "Develop a Player Status," and "Compare Player Ratings." In response to selection of "Simple Instructions," various instructions are shown (see FIG. 15 for an example). Here a first-time user may, for example, view instructions about how to use the computer system.

Figure 16:
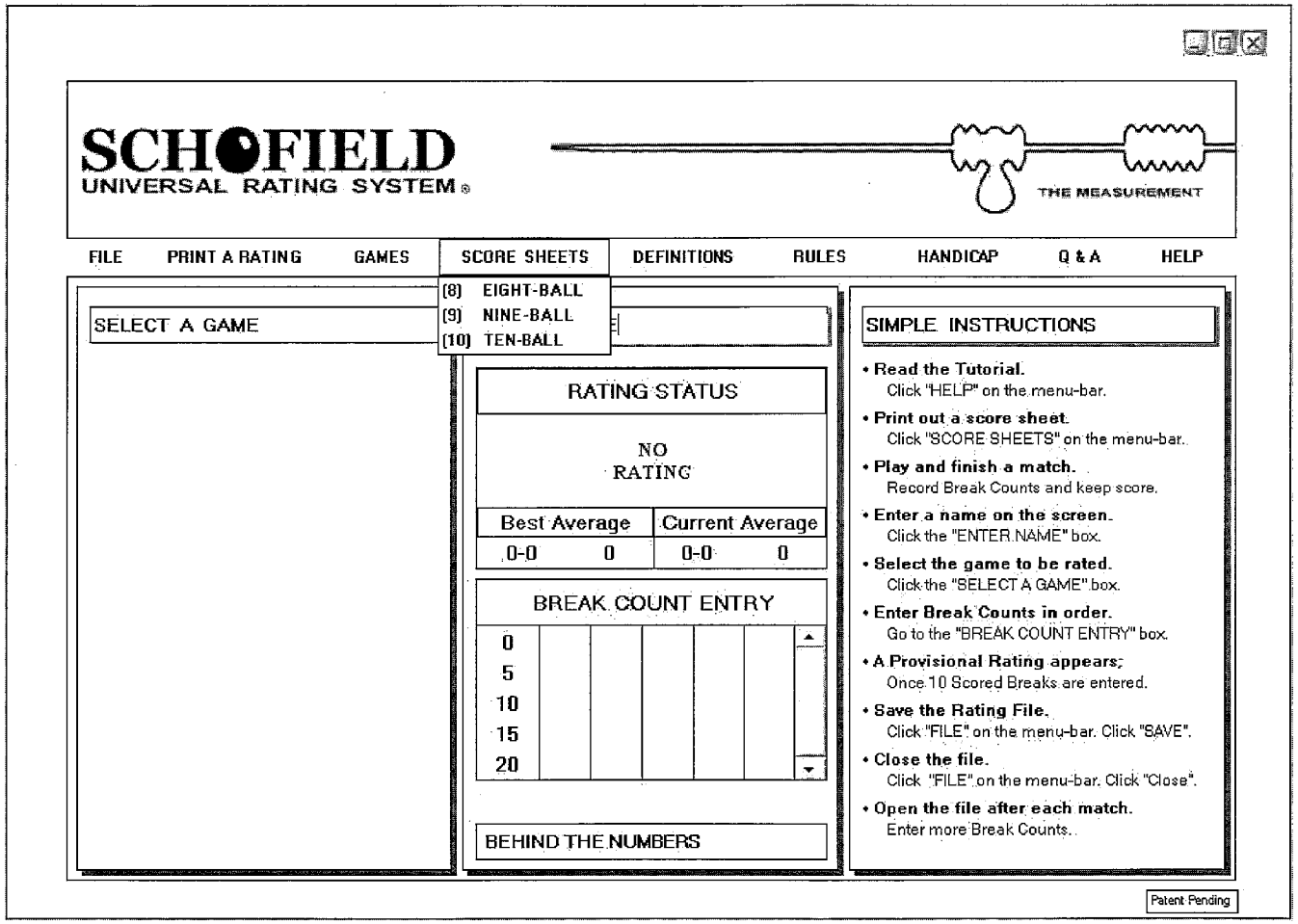

In response to selection of "Score Sheets" option, a drop-down menu such as shown in FIG. 16 may be presented, giving the user the option of printing score sheets from three games, Eight-ball, Nine-ball, or Ten-ball. In response to the selection of "Eight-ball" from the drop-down menu in FIG.

Figure 16A:
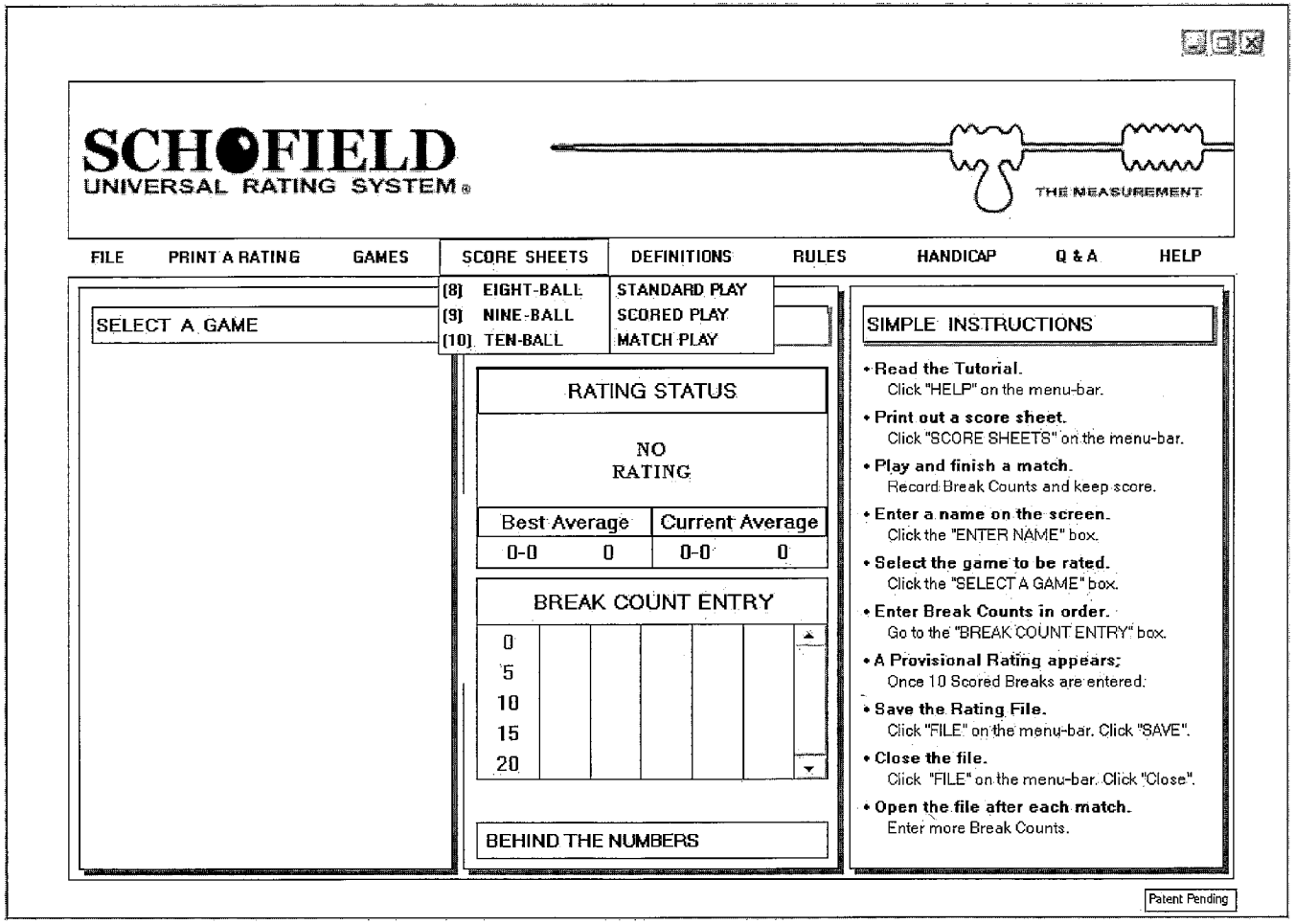
Figure 16B:
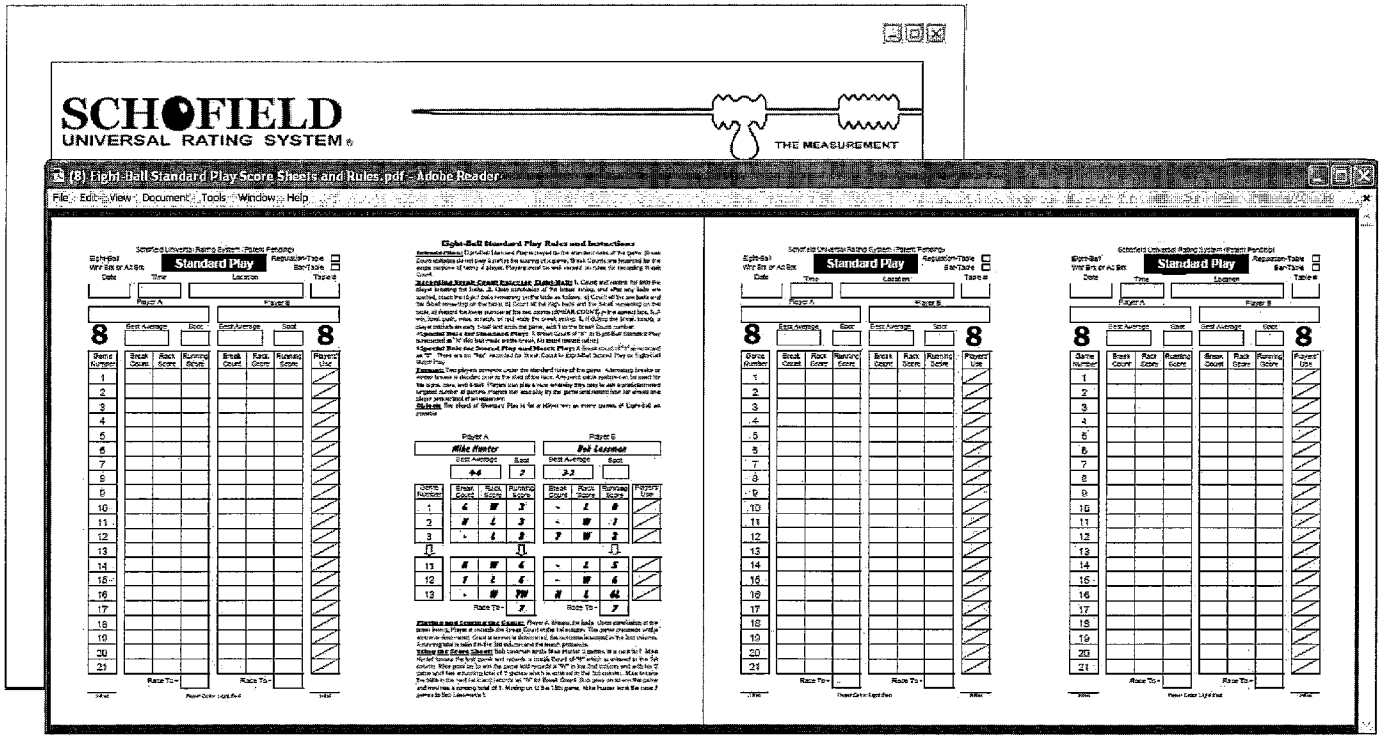
Figure 17:
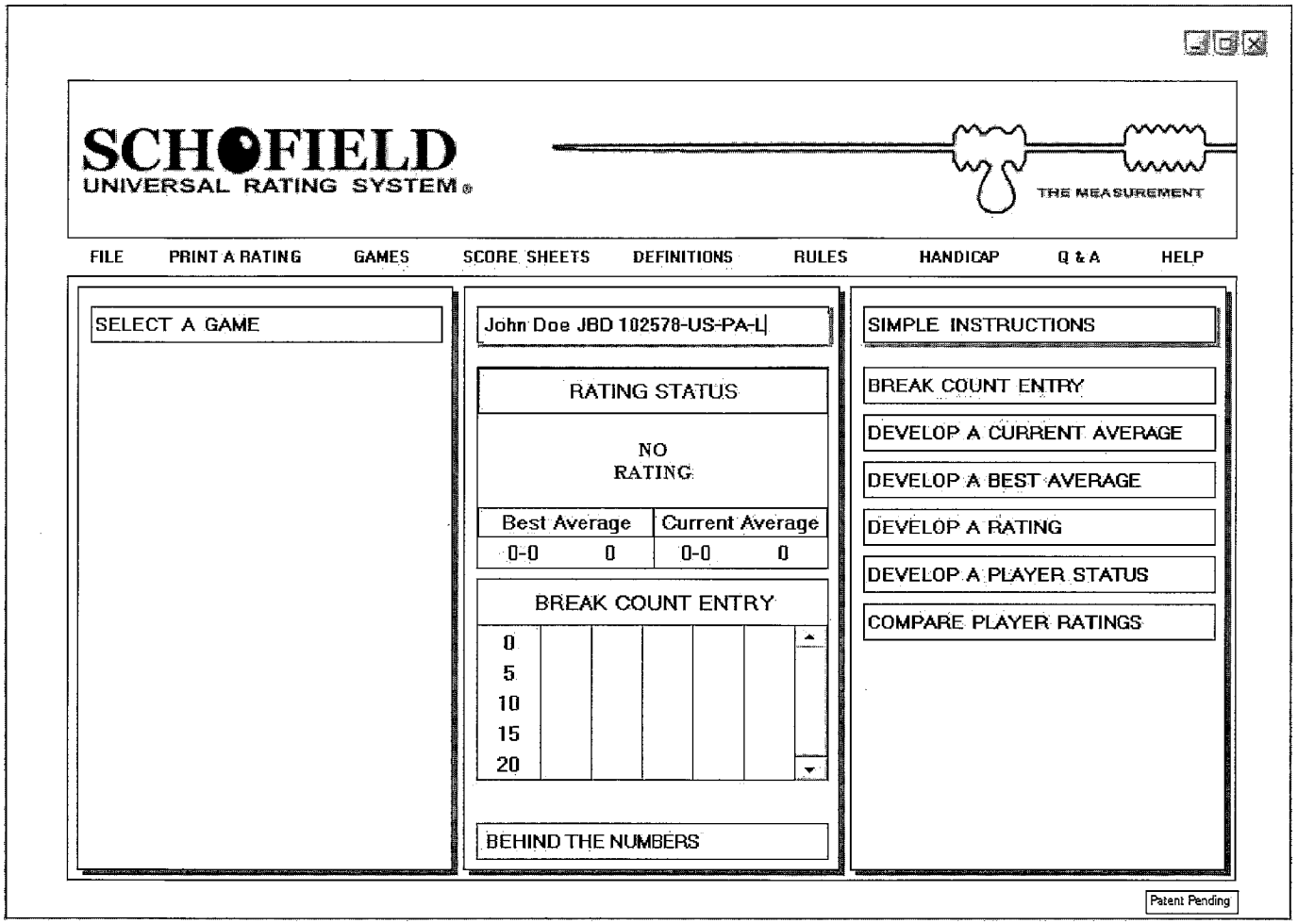

16, the additional drop-down menu of FIG. 16*a* is presented, offering the options of "Standard Play," "Scored Play," and "Match Play." In response to the selection of "Standard Play" from the drop-down menu of FIG. 16*a*, instructions and rules for the selection is presented, which may optionally include a score sheet, and in particular a second page with a separate double score sheet as shown in FIG. 16*b* which the user can print out to make copies. The computer responds similarly if "Scored Play" or "Match Play" is selected, although the content of the instructions and rules (and any score sheet) is correspondingly different. The same interaction is present if "Nine-ball" or "Ten-ball" is selected from the drop-down menu in FIG. 16.

The computer system in the embodiment of FIG. 11 preferably enables, and requires, the entry of personal information for each player, such as a picture, home town, home venue, etc. The computer system can utilize different extents of player information. For example, a particular embodiment may or may not include contact information for each person. Different embodiments can have different access to player information. The player profile information can be publicly listed and viewable by all other registered users.

As an example shown in FIG. 16*b*, a user can select the "Enter Name" field, and enter the name and/or identification number of the player. The identification number may, for example, include three initials, a six digit birth date, a two letter citizenship country code, a two letter state or province code indicating where a player initially registered, and a one letter abbreviation for kind of billiards play. In the example shown in interface 17, the initials of the player are "JBD", his birthdate is Oct. 25, 1978, he is a US citizen, he initially registered in Pennsylvania and is a League player.

Figure 18:
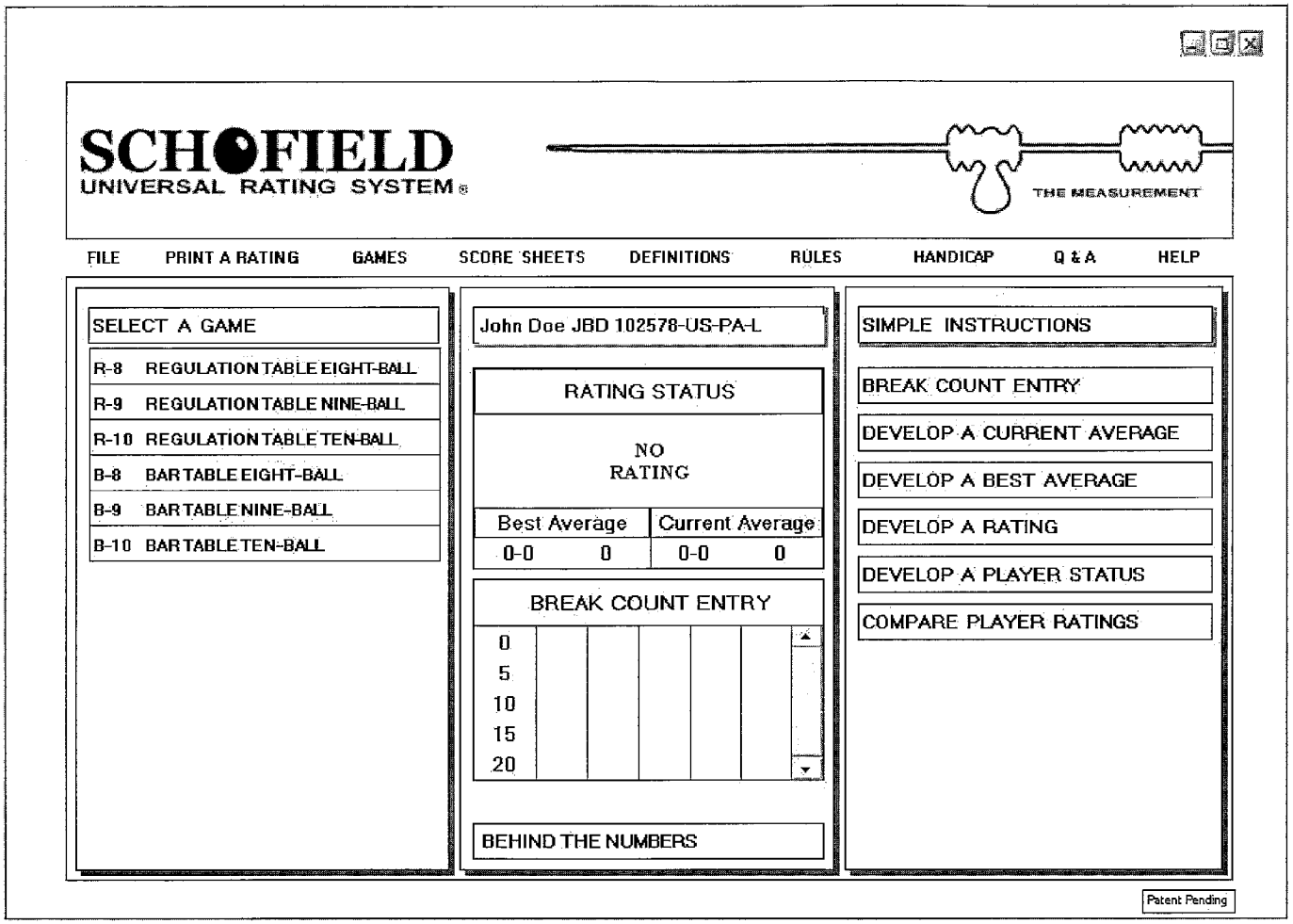
Figure 18A:
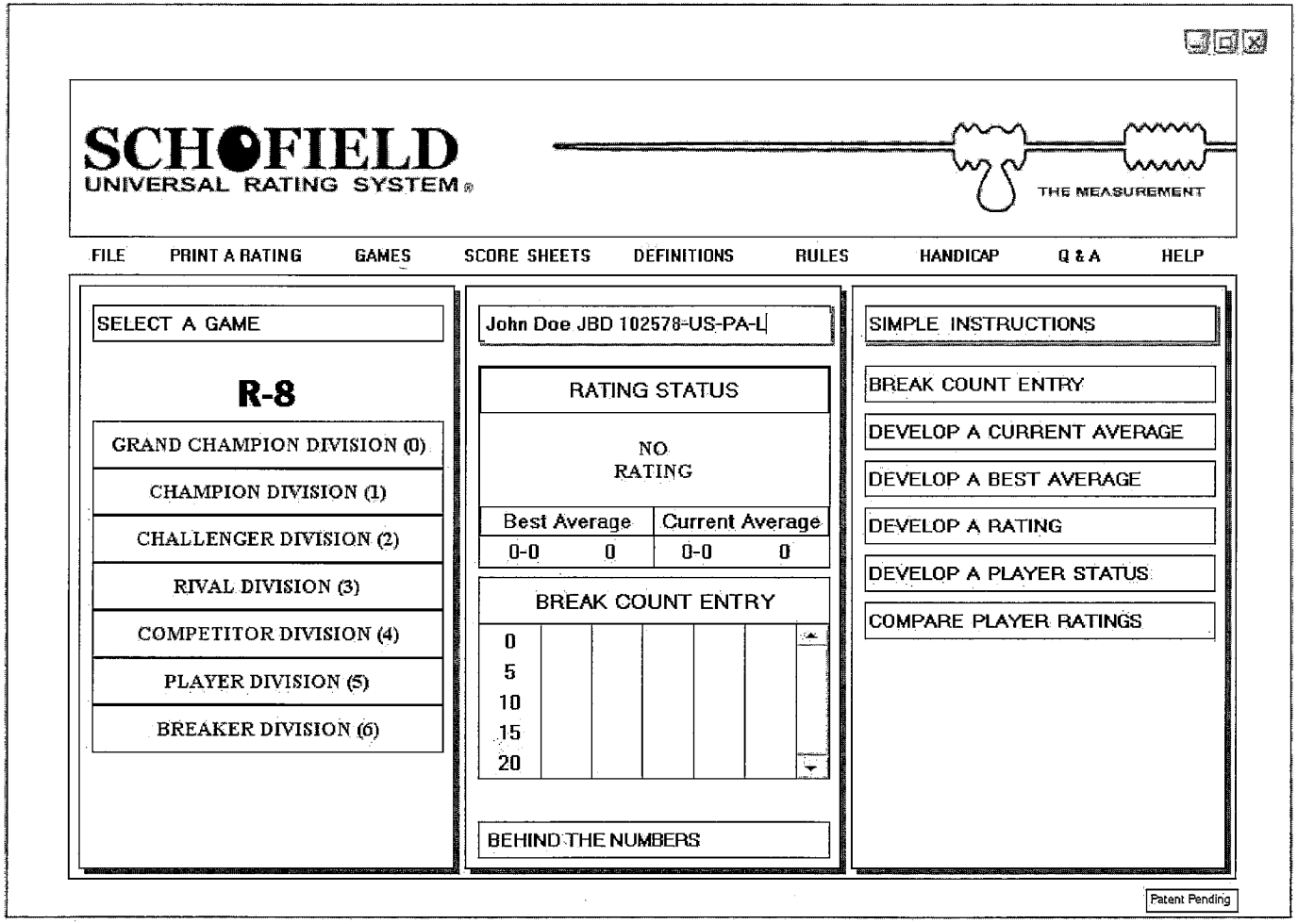
Figure 19:
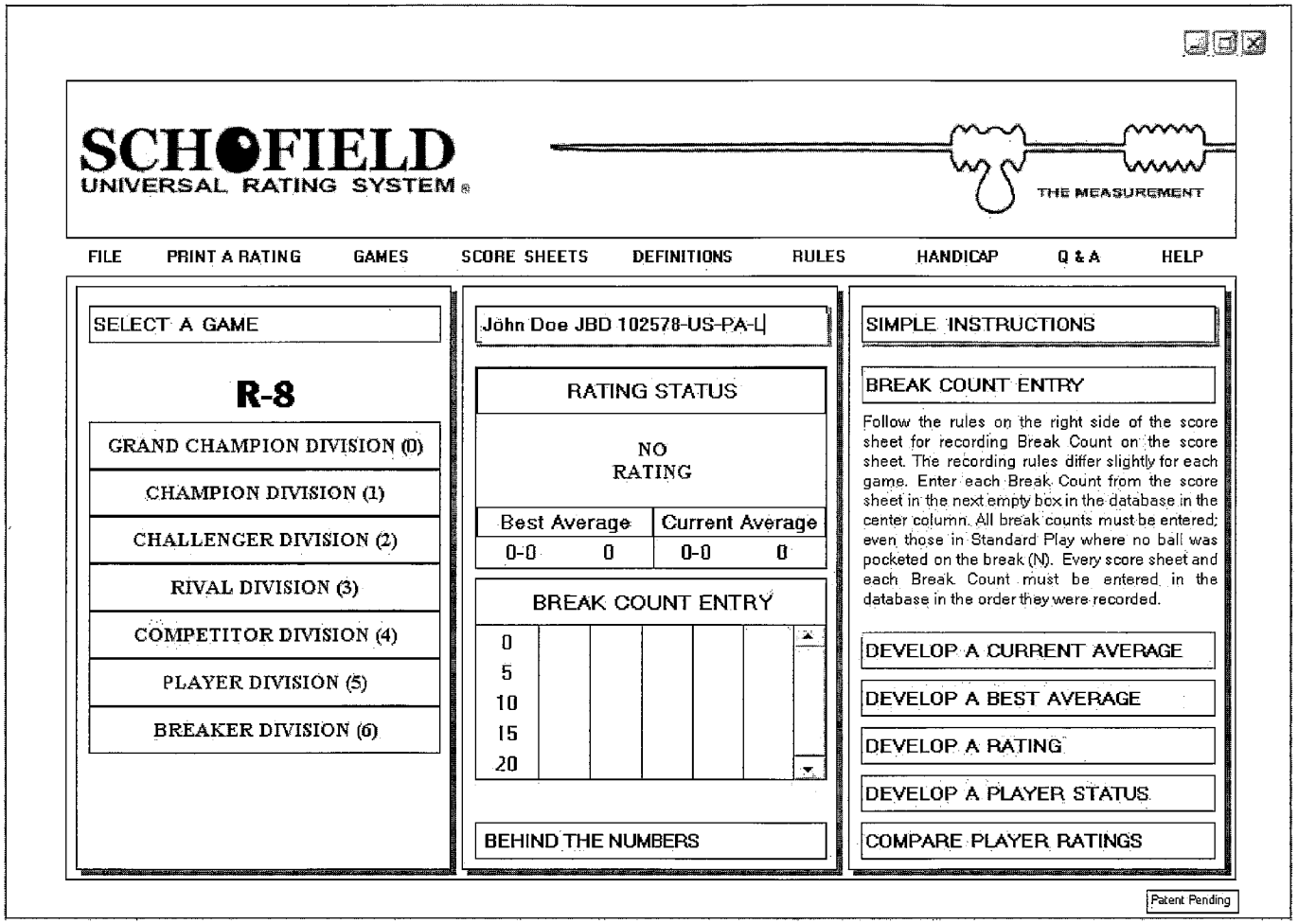

In response to the selection of "Select a Game" in the left-hand column below menu bar 201, the user interface shown in FIG. 18 is presented which lists all combinations of game and table type in the left-hand column. The user then selects one of the games, which may be abbreviated as "R-8", etc., as shown.

In response to the selection of "R-8" in the user interface of FIG. 18, the user interface of FIG. 205*a* is presented. A player's best average and current average (if any) appear in the center column. A list of the player divisions for the selected game appears in the left hand column, with a number in parentheses defining each division in terms of a player's best Break Count average. The first number of a player's best average determines the division to which a player belongs for the selected game. The computer functions comparably when other games are selected.

After playing a match, the user selects "Break Count Entry" from the right hand column below menu bar 201. In response to the selection of "Break Count Entry," instructions for taking and recording break counts appear in the right-hand column in the manner shown in FIG. 19. These rules are quite important as it is essential that every player utilizes the same definition of a break count so that the player ratings are accurate and universal. Naturally, the rules are different for each game: Eight-ball, Nine-ball and Ten-ball.

When the selected game is Eight-ball, the preferred rules displayed by the computer system are as follows:

1. Count and record only for the player breaking the balls.

2. Upon conclusion of the break inning, and after any balls are spotted, perform the following procedure: a) Count all the low balls remaining on the table, as well as the 8-ball if it remains, b) Count all the high balls remaining on the table, as well as the 8-ball if it remains, c) Record the lower number of the numbers (this is the BREAK COUNT).

3. A win, loss, push, miss, scratch, or foul ends the break inning.

4. If during the break inning a player pockets an early 8-ball and ends the game, add 1 to the Break Count number.

A Break Count of "8" in standard play is recorded as "N" (No ball made on the break, No count toward rating).

The Break Count in Eight-Ball is the smaller result of the following two calculations: 1) (8−number of legally pocket solid balls−number of illegally pocketed solid balls−number of solid object balls jumped off the table+1 if the 8-ball is illegally pocketed); and 2) (8−number of legally pocket striped balls−number of illegally pocketed striped balls−number of striped object balls jumped off the table+1 if the 8-ball is illegally pocketed). The simplest method (which gives the same result) is to count object balls remaining on the table.

When the selected game is Nine-Ball, the preferred rules displayed by the computer system are as follows:

1. Count and record only for the player breaking the balls.

2. Upon conclusion of the break inning, and after any balls are spotted, count the object balls remaining on the table and record the number in the correct box (this is the BREAK COUNT).

3. A win, loss, push, miss, scratch, or foul ends the break inning.

4. If during the break inning a player pockets an early 9-ball and ends the game, record the actual Break Count or the first number in the player's Best Average, whichever is lower.

A Break Count of "9" in standard play is recorded as "N" (No ball made on the break, No count toward rating).

The Break Count is calculated as (9−number of legally pocketed object balls−number of illegally pocketed object balls−number of object balls jumped off the table). The simplest method (which gives the same result) is to count object balls remaining on the table.

When the selected game is Ten-Ball, the preferred rules displayed by the computer system are as follows:

1. Count and record only for the player breaking the balls.

2. Upon conclusion of the break inning, and after any balls are spotted, count the object balls remaining on the table and record the number in the correct box (this is the BREAK COUNT).

3. A win, loss, push, miss, scratch, or foul ends the break inning.

4. If during the break inning, a player pockets an early 10-ball and ends the game, record the actual Break Count or the first number in the player's Best Average, whichever is lower.

A Break Count of "10" in standard play is recorded as "N" (No ball made on the break, No count toward rating).

The Break Count is calculated as (10−number of legally pocketed object balls−number of illegally pocketed object balls−number of object balls jumped off the table). The simplest method (which gives the same result) is to count object balls remaining on the table.

In response to the selection of "Break Count Entry" in the middle column below menu bar 201, the interface shown in FIG. 20 (or a similar one) is presented. Here, break counts are keyed into the computer in order. The number on the left of the middle column is the number of Break Counts previously recorded. After entry of a break count, the computer automatically moves the cursor to the next box prompting the user to enter another number. As break counts are keyed in, the results are immediately reflected in the best average and current average displayed above the Break Count Entry box.

By right clicking with a mouse (or similar input interaction) on any previously entered break count in FIG. 20, the user is provided information on the break count, such as the specific number entered for the break count, the number of break counts entered to that point, and the date on which it was entered. The user is also presented with four options: 1) Update the Break Count; 2) Insert a Break Count before; 3) Insert a Break Count after; and 4) Delete a Break Count. The user can choose one of the four options to change the break count data.

Once break counts are entered, the user may click on "File" on the menu bar 201 and select "Save" to permanently save the file. Preferably, the break count data cannot be changed once it is saved. All entered break count data related to the named player is saved in a single file, along with all personal information, and all of the player's previous break counts for all games and table sizes. All player files are stored in the same central data base.

Figure 21:
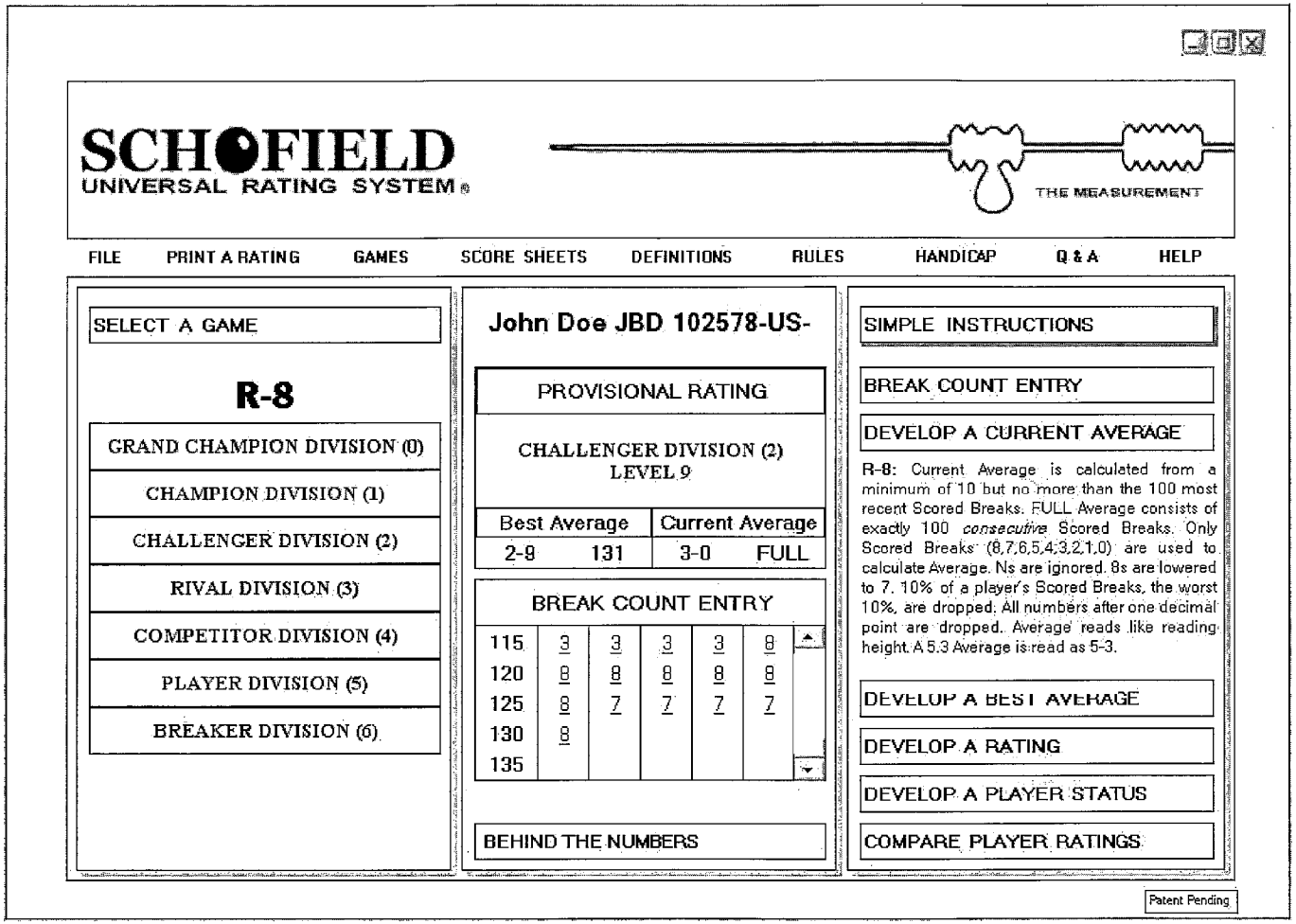

In response to the selection of "Develop a Current Average" in the right hand column below menu bar 201, the user interface shown in FIG. 21 is presented. A paragraph appears on the right hand side column below menu bar 201 explaining how a current average is calculated for the selected game. In the R-8 example shown in FIG. 21, the current average is calculated using the most recent 100 scored breaks (with a minimum of 10 scored breaks if a player is to have an average at all). A FULL Average consists of exactly 100 consecutive scored breaks. Only scored breaks (8, 7, 6, 5, 4, 3, 2, 1, 0) are used to calculate the current average. All Ns are ignored and all 8's are lowered to 7's. A player's worst 10% of scored breaks are dropped. The current average is calculated by taking the total of all break counts used in the calculation, divided by the number of break counts used in the calculation. All numbers after one decimal point are dropped. An average is preferably represented with a dash (like a person's height). For example, a 5.3 Average is read as "5-3". The number of break counts applied toward current average is shown just to the right of the current average. In the example of FIG. 21, the current average is a FULL average consisting of 100 scored breaks. Preferably, the minimum number of score breaks, the number of scored breaks necessary for a full average, and the percentage of worst dropped scored breaks are variables that can be adjusted in the rating system (although not by the player themselves).

Figure 22:
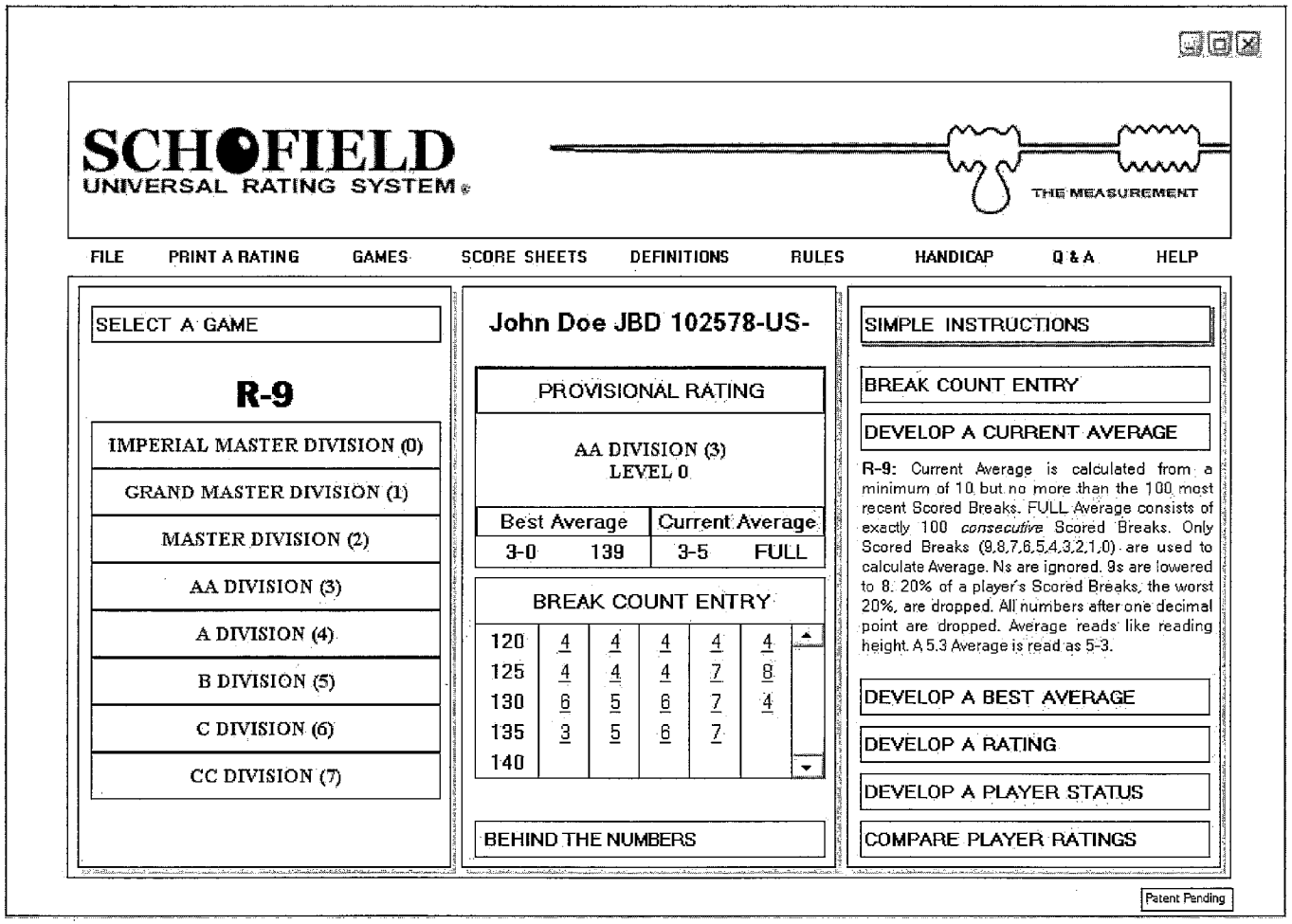

FIG. 22 shows a similar interface in response to the selection of "Develop a Current Average" in the right hand column when R-9 is the selected game. A paragraph appears on the right hand side column below menu bar 201, explaining how a current average is calculated and is represented. The current average is calculated using the most recent 100 scored breaks (with a minimum of 10 scored breaks if a player is to have an average at all). A FULL Average consists of exactly 100 consecutive scored breaks. Only scored breaks (9, 8, 7, 6, 5, 4, 3, 2, 1, 0) are used to calculate the current average. All Ns are ignored and all 9's are lowered to 8's. A player's worst 20% of scored breaks are dropped. The current average is calculated by taking the total of all break counts used in the calculation, divided by the number of break counts used in the calculation. All numbers after one decimal point are dropped. An average is represented with a dash (like a person's height). A 5.3 Average is read as "5-3". The number of break counts applied toward current average is shown just to the right of the current average. Preferably, the minimum number of score breaks, the number of scored breaks necessary for a full average, and the percentage of worst dropped scored breaks are variables that can be adjusted in the rating system (although not by the player themselves).

Figure 23:
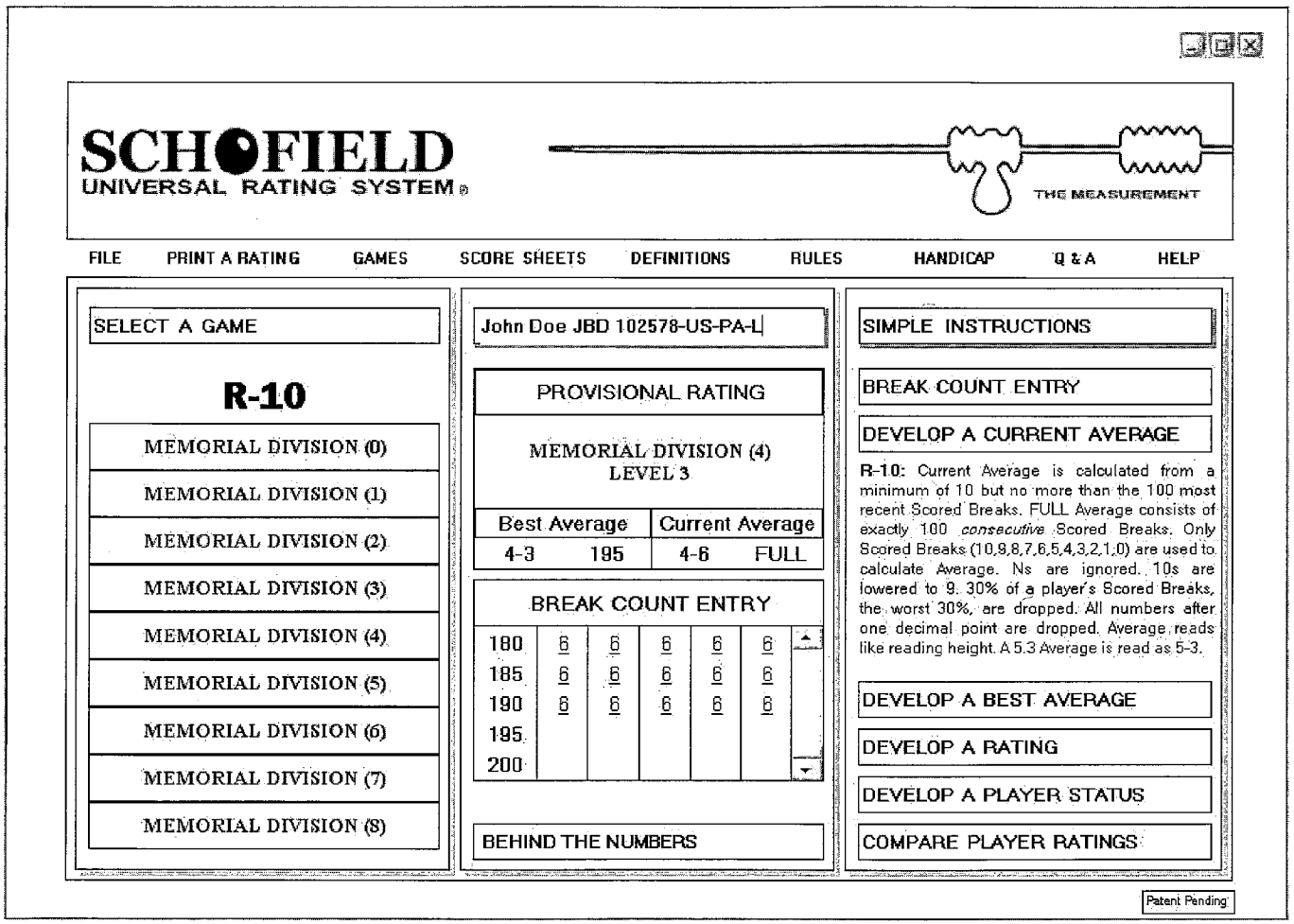

FIG. 23 shows a similar interface displayed in response to the selection of "Develop a Current Average" in the right hand column when R-10 is the selected game. A paragraph appears on the right hand side, explaining how a current average is calculated and is represented. The current average is calculated using the most recent 100 scored breaks (with a minimum of 10 scored breaks if a player is to have an average at all). A FULL Average consists of exactly 100 consecutive scored breaks. Only scored breaks (10, 9, 8, 7, 6, 5, 4, 3, 2, 1, 0) are used to calculate Average. All Ns are ignored and all 10's are lowered to 9's. A player's worst 30% of scored breaks are dropped. The current average is calculated by taking the total of all break counts used in the calculation, divided by the number of break counts used in the calculation. All numbers after one decimal point are dropped. An average is represented with a dash (like a person's height). A 5.3 Average is read as "5-3". The number of break counts applied toward current average is shown just to the right of the current average. Preferably, the minimum number of score breaks, the number of scored breaks necessary for a full average, and the percentage of worst dropped scored breaks are variables that can be adjusted in the rating system (although not by the player themselves).

Figure 24:
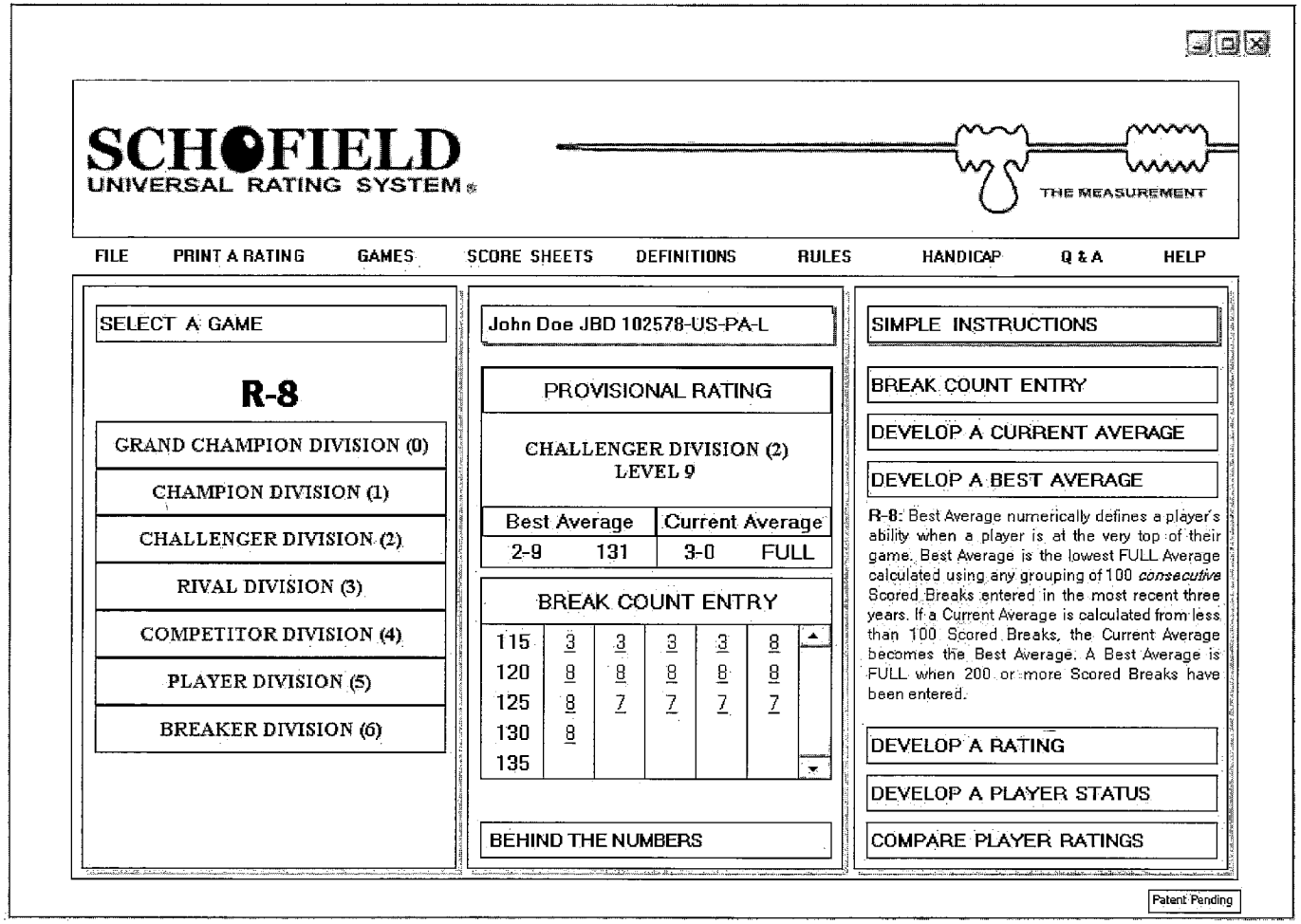

In response to the selection of "Develop a Best Average" in the right hand column below menu bar 201, the user interface shown in FIG. 24 is presented. A paragraph appears in the right hand column, explaining how a best average is calculated and is represented when the selected game is R-8. The best average numerically represents a player's ability when at the very top of his/her game. The best average is the lowest FULL Average calculated using any grouping of 100 consecutive scored breaks entered in the most recent three years. If the current average is calculated using fewer than 100 scored breaks, then the current average becomes the best average. A best average is FULL when 200 or more Scored Breaks have been entered. The number of break counts applicable toward the best average is shown just to the right of the best average. Preferably, the number of score breaks used to calculate the best average, the number of scored breaks necessary for a FULL best average, and the time limitation for scored breaks are variables that can be adjusted in the rating system (although not by the player themself).

Figure 25:
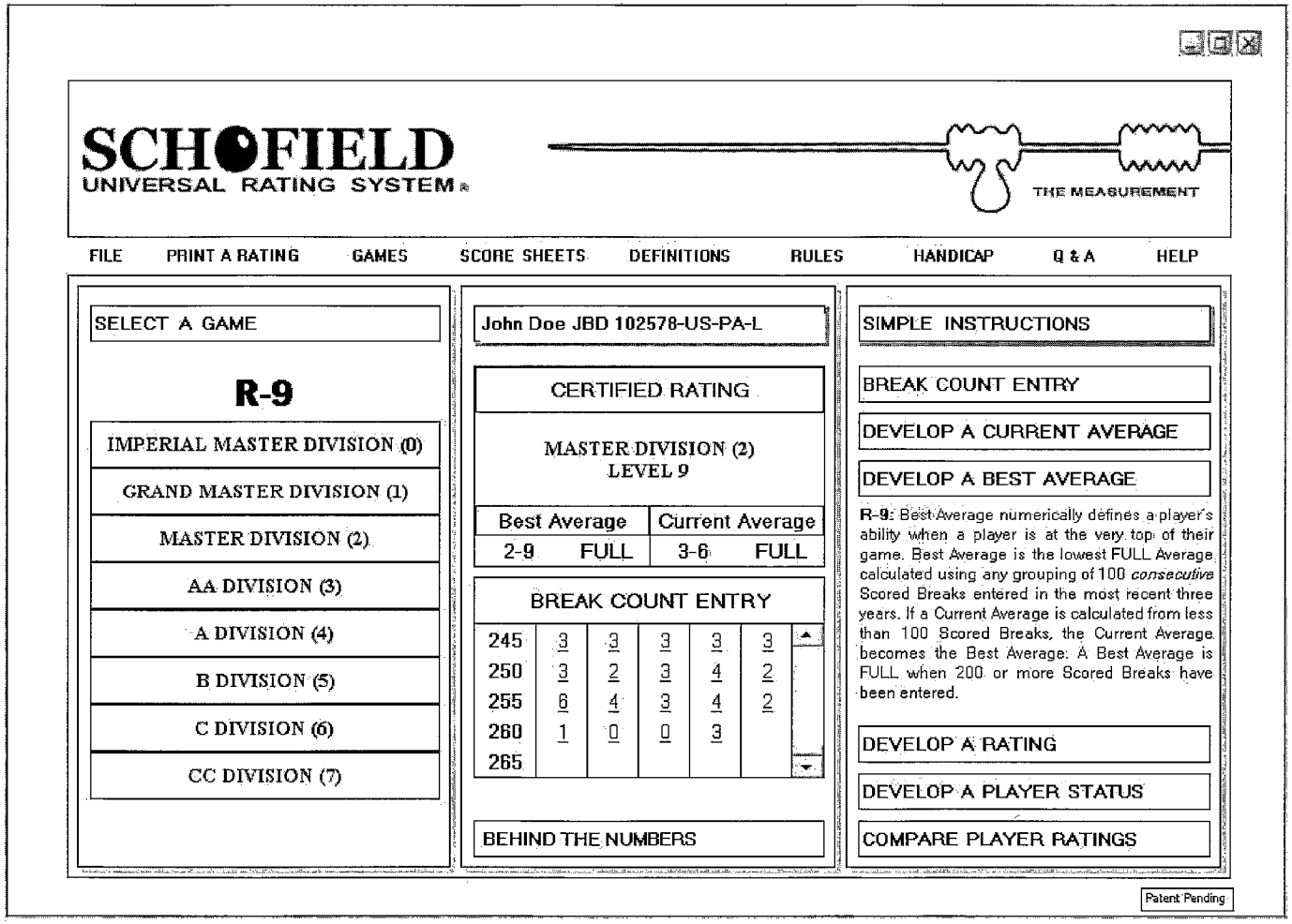

In response to the selection of "Develop a Best Average" in the right hand column below menu bar 201, the user interface shown in FIG. 25 is presented. A paragraph appears on the right hand column, explaining how a best average is calculated and is represented when the selected game is R-9. The best average numerically represents a player's ability when at the very top of his/her game. The best Average is the lowest FULL Average calculated using any grouping of 100 consecutive Scored Breaks entered in the most recent three years. If a Current Average is calculated using fewer than 100 Scored Breaks, the Current Average becomes the Best Average. A Best Average is FULL when 200 or more Scored Breaks have been entered. The number of Break Counts applicable toward the Best Average is shown just to the right of the Current Average. Preferably, the number of score breaks used to calculate the best average, the number of scored breaks necessary for a FULL best average, and the time limitation for scored breaks are variables that can be adjusted in the rating system (although not by the player themself).

Figure 26:
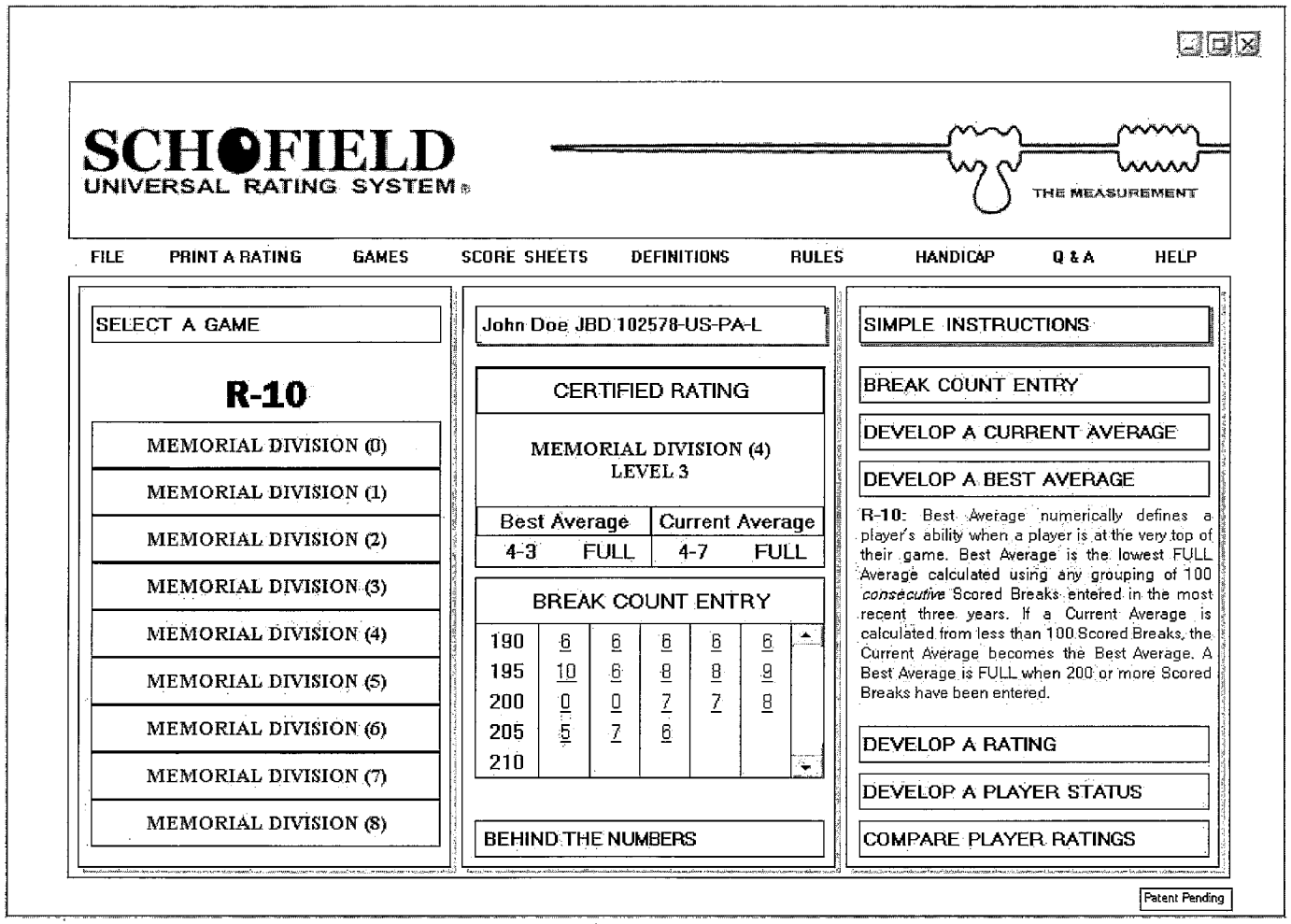

In response to the selection of "Develop a Best Average" in the right hand column below menu bar 201, the user interface shown in FIG. 26 is presented. A paragraph appears in the right hand column, explaining how a best average is calculated and is represented when the selected game is R-10. The Best Average numerically represents a player's ability when at the very top of his/her game. Best Average is the lowest FULL Average calculated using any grouping of 100 consecutive Scored Breaks entered in the most recent three years. If a Current Average is calculated using fewer than 100 Scored Breaks, the Current Average becomes the Best Average. A Best Average is FULL when 200 or more Scored Breaks have been entered. The number of Break Counts applicable toward the Best Average is shown just to the right of the Current Average. Preferably, the number of score breaks used to calculate the best average, the number of scored breaks necessary for a FULL best average, and the time limitation for scored breaks are variables that can be adjusted in the rating system (although not by the player themself).

FIGS. 21-26 show the user interface for the current average and best average when R-8, r-9 and R-10 are the selected games. The user interface for the current average and best average when the selected game is for a bar table is preferably the same as that of the corresponding regulation table.

Figure 27:
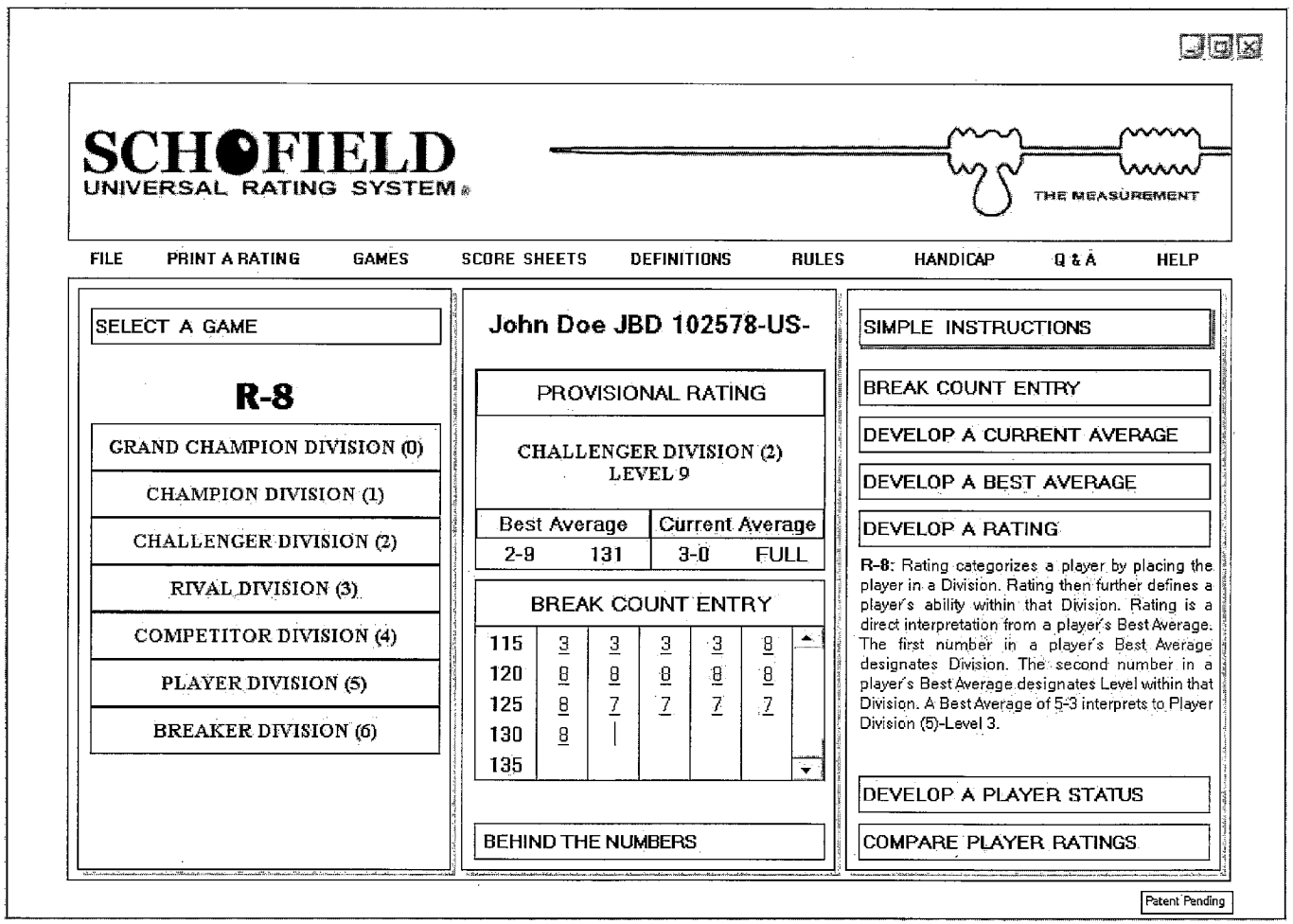

In response to the selection of "Develop a Rating" in the right hand column below menu bar 201 when the selected game is R-8, the user interface shown in FIG. 27 is presented. The player's rating designation is located in the middle column below menu bar 201 and above the Best Average and Current Average, and a paragraph appears on the right hand column, explaining the Rating Designation for R-8. The explanation indicates that the Rating categorizes a player by placing him/her in a Division. Rating then further defines a player's ability within that Division. Rating is assigned according to a player's Best Average, with the first number in a player's Best Average designating his/her Division. The second number in a player's Best Average designates Level within that Division. A Best Average of 5-3 interprets to Player Division-Level 3.

Figure 28:
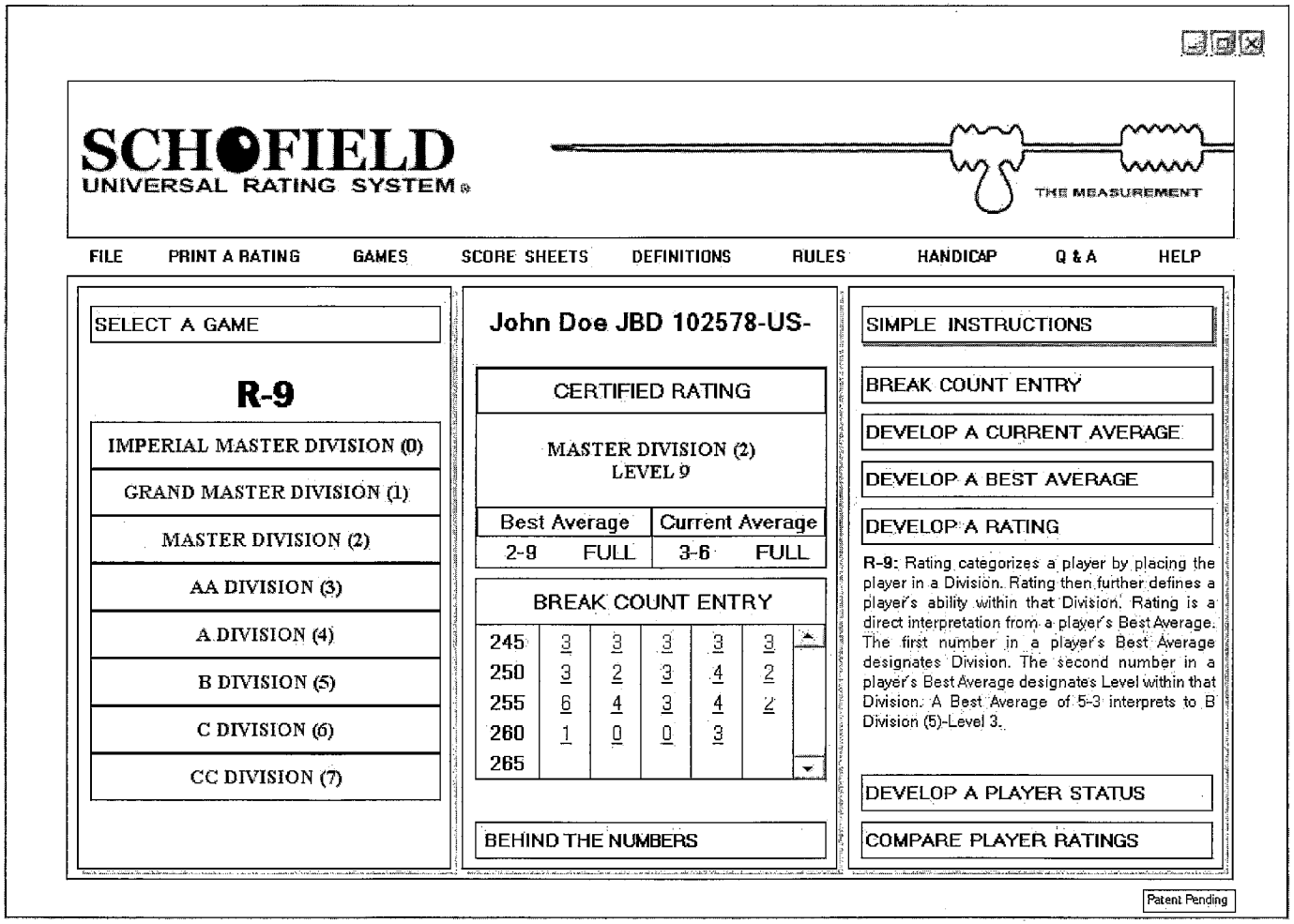

In response to the selection of "Develop a Rating" in the right hand column below menu bar 201 when the selected game is R-9, the user interface shown in FIG. 28 is presented. The player's rating designation is located in the middle column below menu bar 201 and above Best Average and Current Average, and a paragraph appears on the right hand side, explaining the Rating Designation for R-9. Rating categorizes a player by placing him/her in a Division. Rating then further defines a player's ability within that Division. Rating is assigned according to a player's Best Average, with the first number in a player's Best Average designating his/her Division. The second number in a player's Best Average designates Level within that Division. A Best Average of 5-3 translates to B Division-Level 3.

Figure 29:
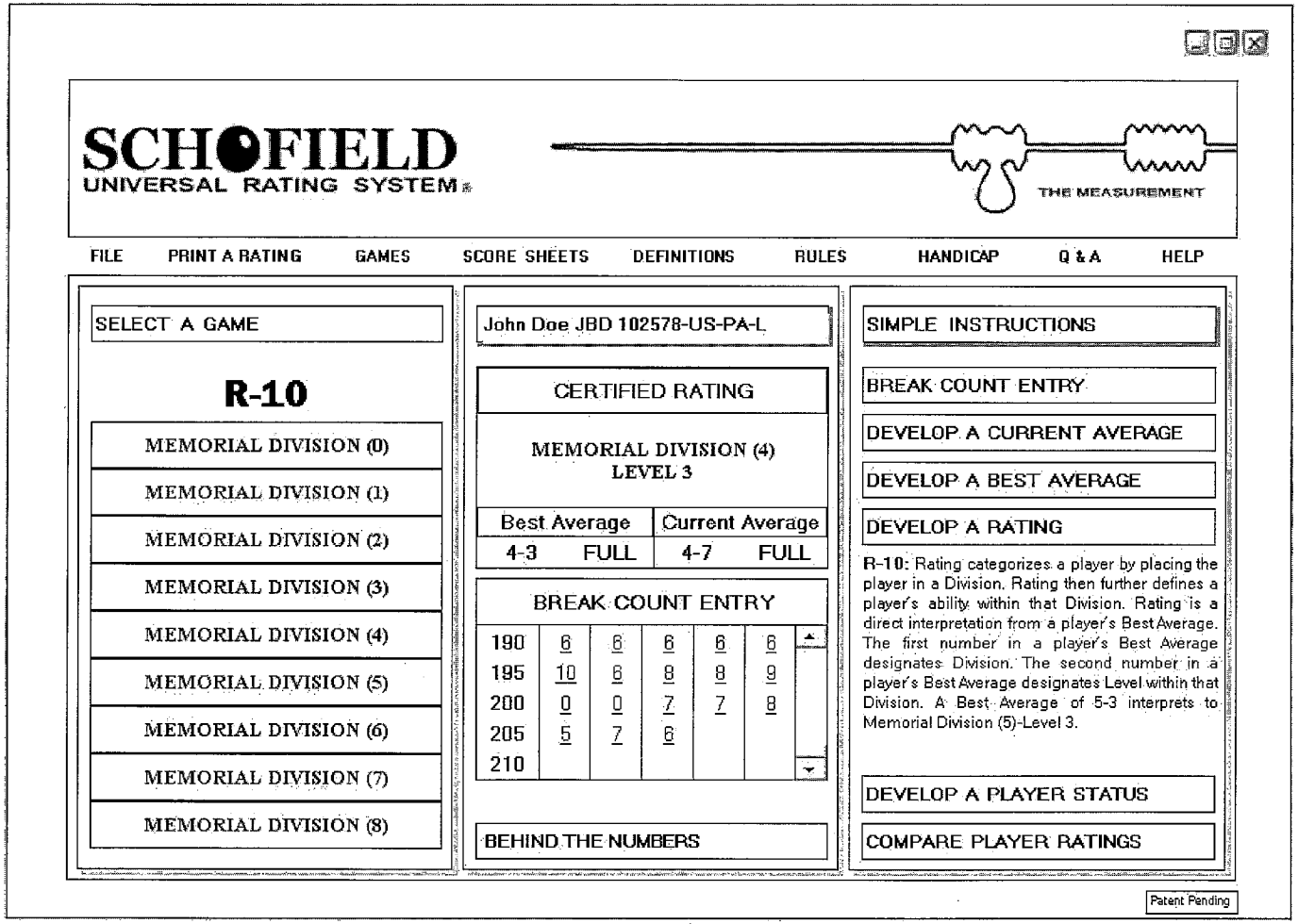

In response to the selection of "Develop a Rating" in the right hand column below menu bar 201 when the selected game is R-10, the user interface shown in FIG. 29 is presented. The player's rating designation is located in the middle column above Best Average and Current Average, and a paragraph appears on the right hand side, explaining the Rating Designation for R-10. Rating categorizes a player by placing him/her in a Division. Rating then further defines a player's ability within that Division. Rating is assigned according to a player's Best Average, with the first number in a player's Best Average designating his/her Division. The second number in a player's Best Average designates Level within that Division. A Best Average of 5-3 translates to Memorial Division-Level 3.

Figure 30:
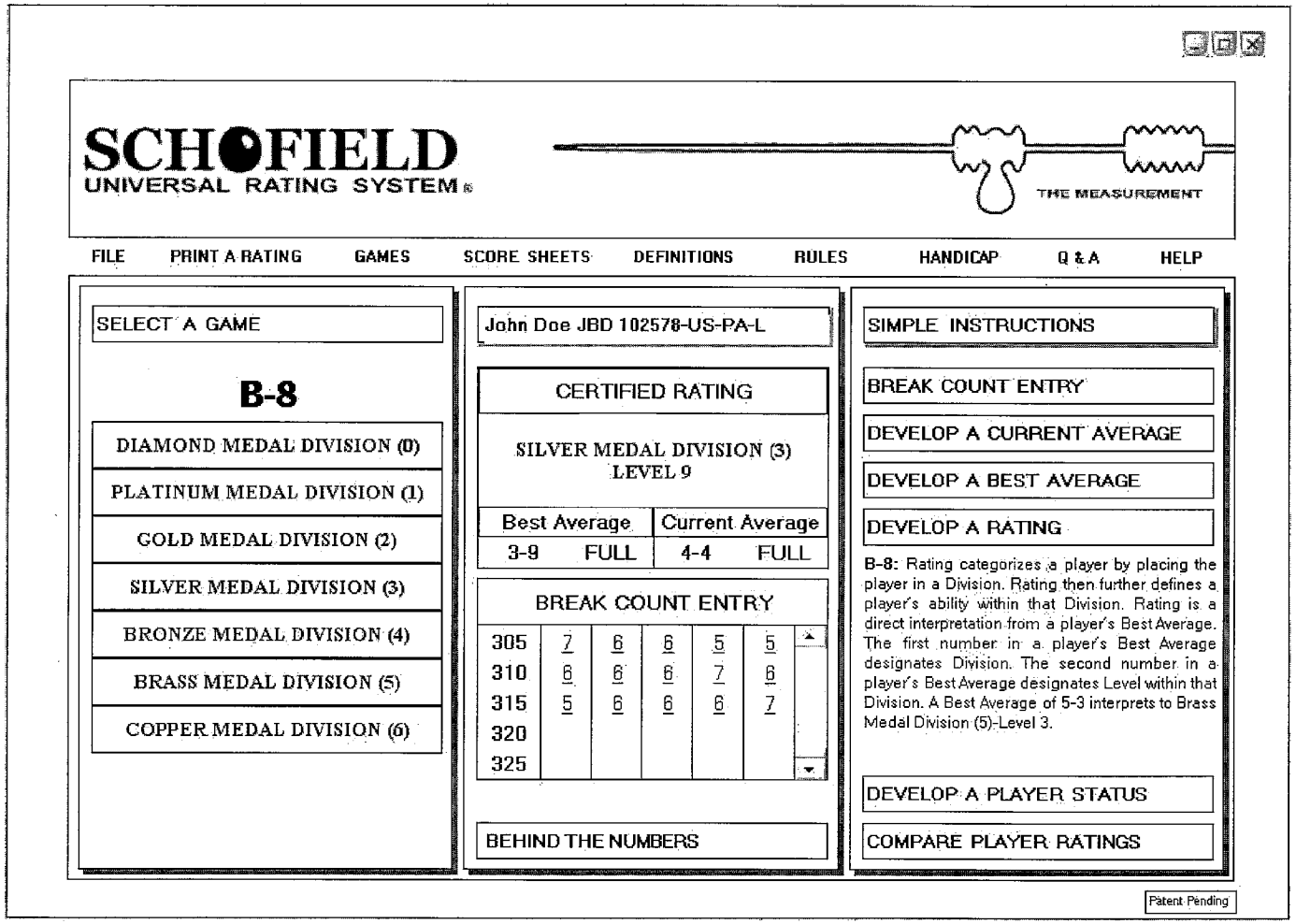

In response to the selection of "Develop a Rating" in the right hand column below menu bar 201 when the selected game is B-8, the user interface shown in FIG. 30 is presented. The player's rating designation is located in the middle column above Best Average and Current Average, and a paragraph appears on the right hand column, explaining the Rating Designation for B-8. Rating categorizes a player by placing him/her in a Division. Rating then further defines a player's ability within that Division. Rating is assigned according to a player's Best Average, with the first number in a player's Best Average designating his/her Division. The second number in a player's Best Average designates Level within that Division. A Best Average of 5-3 translates to Brass Medal Division-Level 3.

Figure 31:
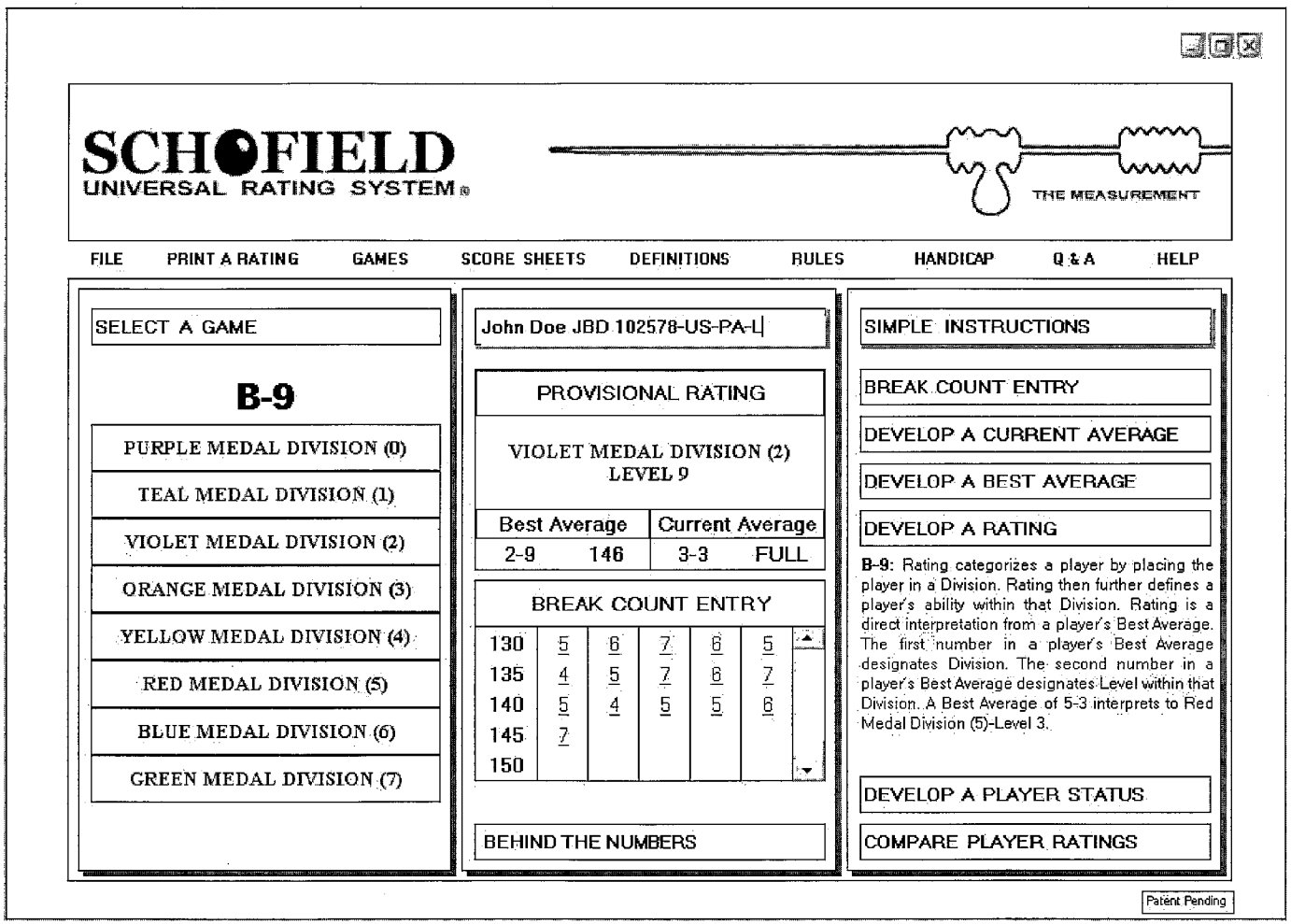

In response to the selection of "Develop a Rating" in the right hand column below menu bar 201 when the selected game is B-9, the user interface shown in FIG. 31 is presented. The player's rating designation is located in the middle column above Best Average and Current Average, and a paragraph appears on the right hand side, explaining the Rating Designation for B-9. Rating categorizes a player by placing him/her in a Division. Rating then further defines a player's ability within that Division. Rating is assigned according to a player's Best Average, with the first number in a player's Best Average designating his/her Division. The second number in a player's Best Average designates Level within that Division. A Best Average of 5-3 translates to Red Medal Division-Level 3.

Figure 32:
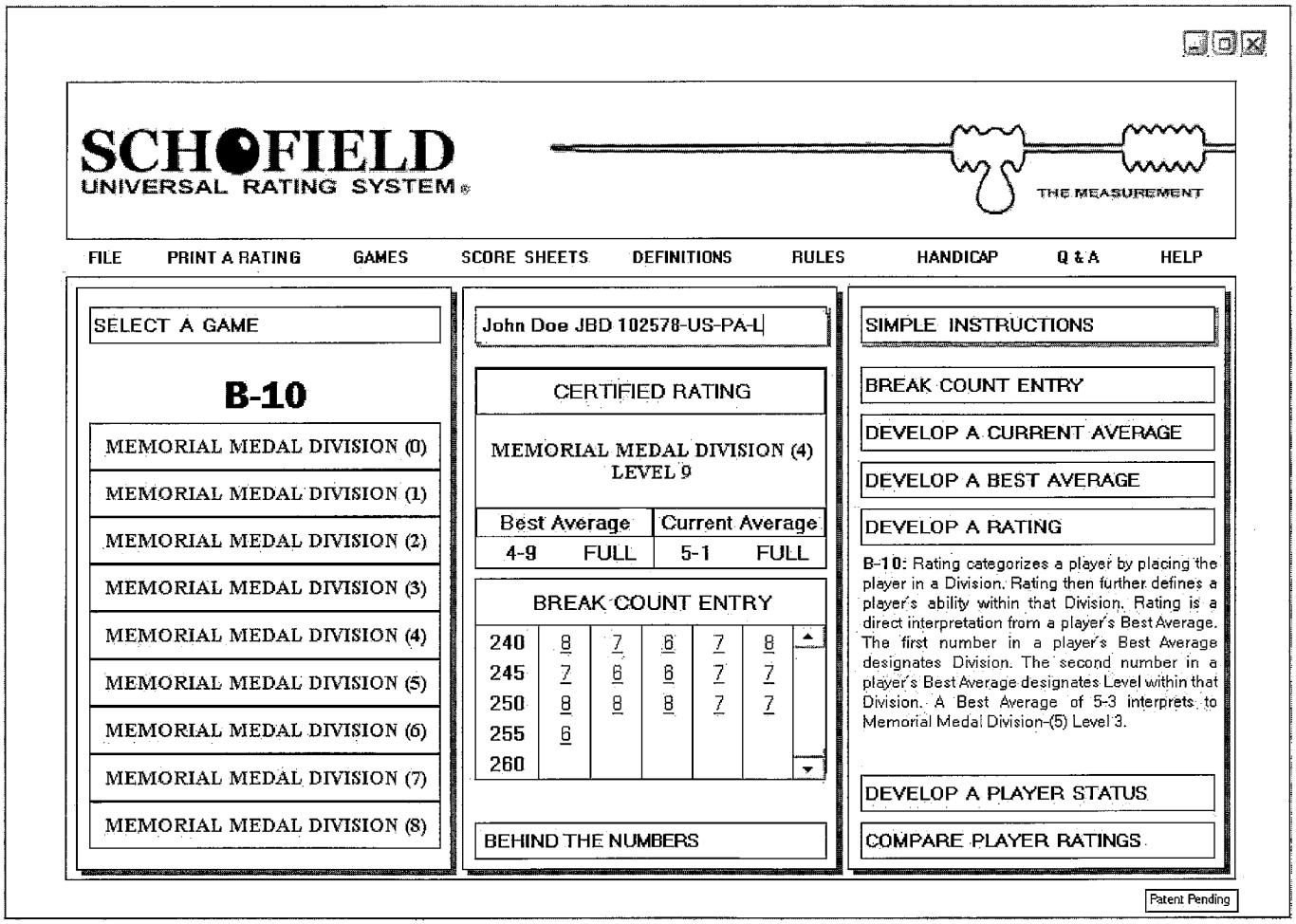

In response to the selection of "Develop a Rating" in the right hand column below menu bar 201 when the selected game is B-10, the user interface shown in FIG. 32 is presented. The player's rating designation is located in the middle column above Best Average and Current Average, and a paragraph appears in the right hand column, explaining the Rating Designation for B-10. Rating categorizes a player by placing him/her in a Division. Rating then further defines a player's ability within that Division. Rating is assigned according to a player's Best Average, with the first number in a player's Best Average designating his/her Division. The second number in a player's Best Average designates Level within that Division. A Best Average of 5-3 translates to Memorial Medal Division-Level 3.

Figure 33:
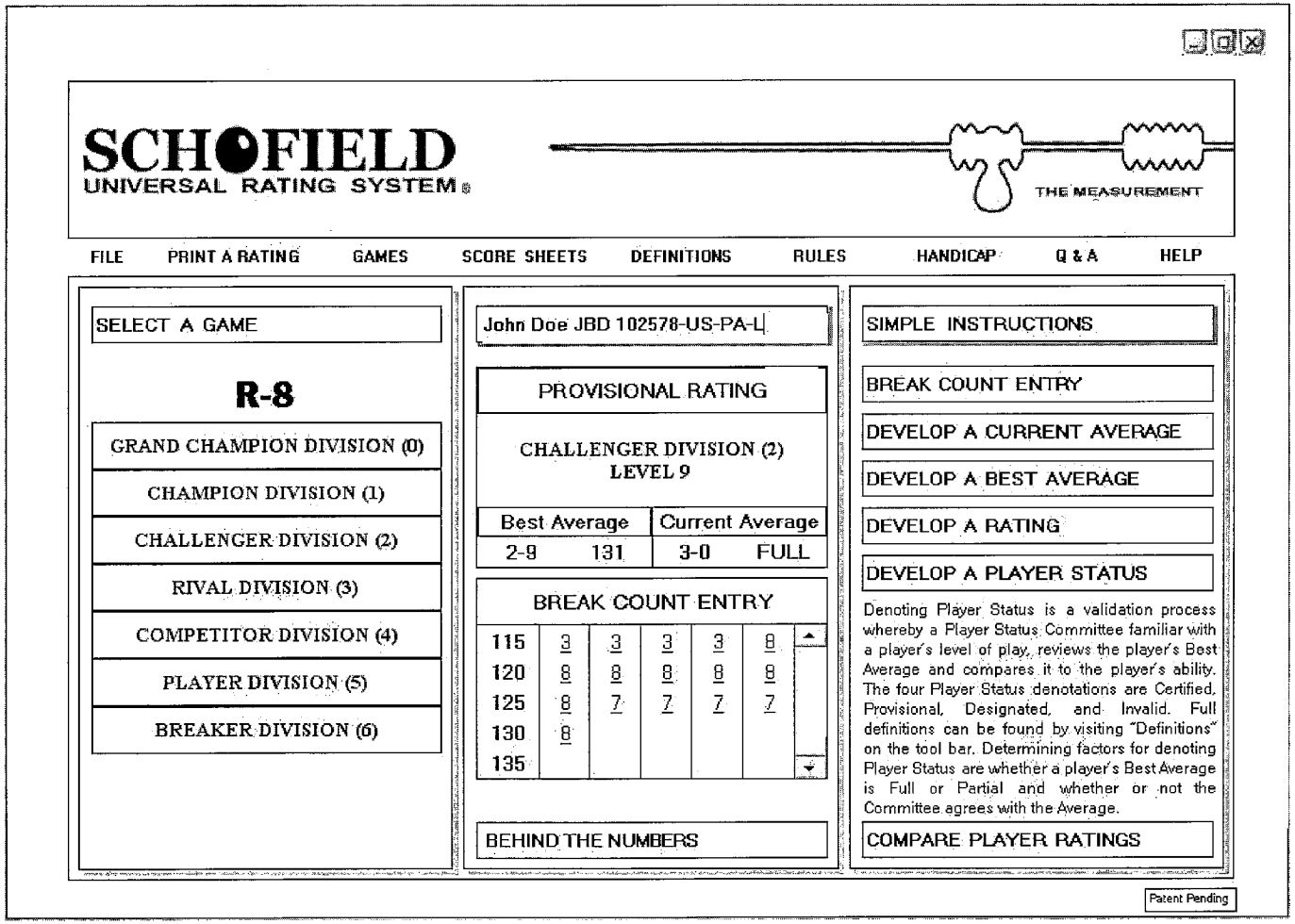

In response to the selection of "Develop a Player Status" in the right hand column below menu bar 201 when the selected game is R-8, the user interface shown in FIG. 33 is displayed. A paragraph appears in the right hand column explaining the different status denotations. Preferably, the same explanation appears regardless of the selected game.

Figure 34:
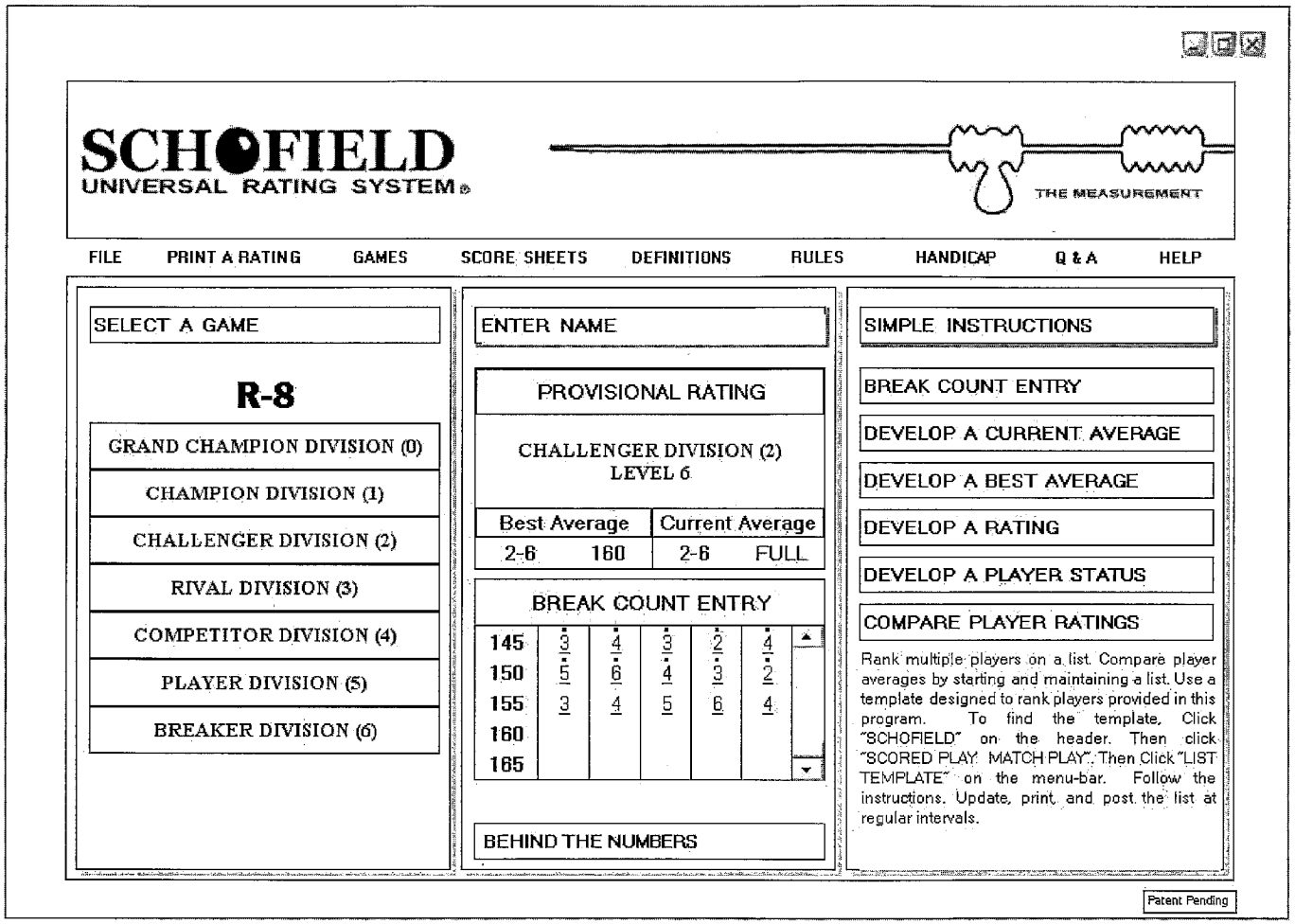

In response to the selection of "Compare Player Ratings" in the right hand column below menu bar 201, a user interface such as the example shown in FIG. 34 when the selected game is R-8 is presented. A paragraph appears in the right hand column providing instructions on how to build a list that compares the averages of players within the system. Users are prompted to select parameters for the list. Possible parameters include location options, game, table size, division, status, age, and gender. The comparison list gives perspective as to a player's place in the broader pocket billiard community, and can be used for organizing a divisionalized tournament, and assembling league teams that are not to exceed an aggregate ability threshold. FIG. 34*a* shows an exemplary template for player rating listings when the selected game is R-8. The information to be provided in the exemplary template of FIG. 34*a* includes Player Status, Player Name, Rating, Best Average, and number of games, and Current Average and number of games.

There may be a variety of other functions provided by the computer system as well, such as: (1) a member can sort player data using a number of parameters, such as: a count list, state list, zip codes, within so many miles, leagues list, venue list, classification, certification status, etc.; (2) a league can use the system to rate its players; and (3) a pool room can use the program to distinguish between serious players and recreational players, offering a reduced rate to play and/or to participate in the rating system.

The menu bar 201 also has a "Handicap" option provided to handicap players (that is, to determine how the score of a game between two competitors with unequal skill would need to be adjusted so as to make the match even). A handicap can be calculated for any two players or teams of players using Break Count Best Averages.

The universal rating system of the present invention also provides for means and method of handicapping of any given player's abilities. It should be noted that the best events are when handicaps are not used. In addition, the most successful recreational pocket billiard events are team competitions comprised of teams with two to five members. The rating system provides a vehicle and measuring system whereby no handicaps are needed. In forming a league or event, by designating that teams may not have a cumulative best average of less than a certain number, teams will adjust their membership in accordance to the rule. At the same time, the teams will adjust their membership in accordance to the rule. At the same time, the teams will attempt to get as close to the target number allowable. Teams may be required to not only have a cumulative average of less than a certain number; teams may also have to be qualified to participate by having a cumulative average of not more than a certain number. Hence, all teams will play even and parity will be achieved.

Since players are competitive within their respective divisions, primarily for that reason divisional events can be run without handicaps, even though better players will have an advantage. Nonetheless, handicap events have their place in the pocket billiard world. At many pool halls, and on off-seasons, the pool of potential participants can be small. This being the case, the only way to have a successful event with enough players entered in the event, is to open up the field to all players from all divisions. Handicaps between players and teams are a necessity to make the event fair. Handicaps are also used as a tool in developing an enormous, all-inclusive event that brings together players of all abilities, skills, and calibers.

However, there are limitations to any handicapping system. Handicap systems are largely based upon players "playing their best" and "playing their game." If two players of disparate abilities were to have a match, the match would be non-competitive and would rely on other factors than both players "playing their best" and "playing their game." Non-competitive matches alter both players' games, therefore inhibiting and defeating many of the reasons to play and compete. As a result handicapping is useful mostly for players of similar abilities.

The handicapping method comprises a system that works toward increasing the chances of one player winning a match against another player with both players having different—even widely varying—abilities. The following algorithm is thus used to determine the spot or handicap of the player. First, the following designations are used: A—better player's best average; B—lesser player's best average; C—better player's target score or "rate to"; D—lesser player's target score or "race to"; and, E—handicap or spot.

Thus, the handicapping algorithm for Eight-ball is: (C(8−B))/(8−A)=D and therefore C−D=E; the algorithm for Nine-ball is (C(9−B))/(9−A)=D and therefore C−D=E; and the algorithm for Ten-ball is: (C(10−B))/(10−A)=D and therefore C−D=E. It should be noted that as data is compiled the above algorithms can be adjusted, but they serve as a foundation for the development of a fair handicap system.

When the "Handicap" option of menu bar 201 is selected, the computer calculates the handicap to be applied in a match between players A and B in the following manner. The best averages of the players are converted back to their original decimal form (before the decimal point was dropped). The number representing each player's best average is subtracted from 8 if the players are playing Eight-ball, from 9 if the players are playing Nine-ball, and from 10 if the players are playing Ten-ball. The respective differences represent the average number of balls made by each player during the break inning.

The smaller of these two averages is divided by the larger of the two, and multiplied by 100. The result is a percentage assigned to the player with the weaker average. That number is then subtracted from 100. The result is a percentage assigned to the player with the stronger average. The percentage assigned to each player represents the percentage of games that the player would be expected to win in a contest with the other player. (For example, if Player A's percentage is 40, he/she is expected to beat Player B in 40% of the games). A variable (multiplier) is preferably inserted here to develop compatibility between the rating system and the handicap system.

Figure 35:
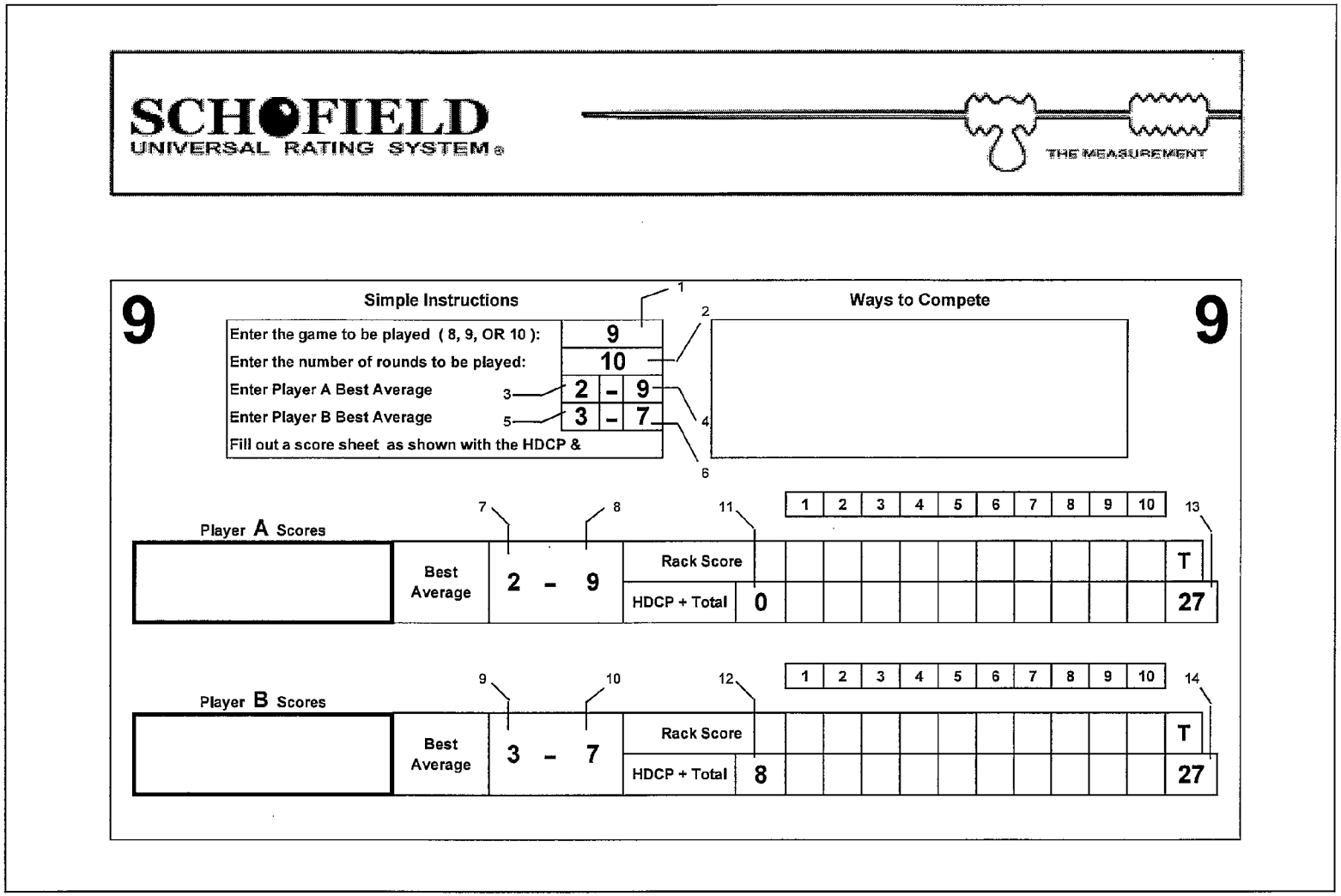

The handicap may be applied through a user interface such as that shown in FIG. 35. A cursor prompts the user to enter the game to be played (8, 9, 10) in field 1, and the number of rounds to be played (1-10) in field 2. The user then enters the first number of Player A's Best Average for the game to be played in field 3, the second number of Player A's Best Average for the game to be played in field 4, the first number of Player B's Best Average for the game to be played in field 5, and the second number of Player B's Best Average for the game to be played in field 6.

The user interface in FIG. 35 shows an example of how a score sheet might be filled out. The first number of Player A's Best Average is entered in field 7 and the second number of Player A's Best Average is entered in field 8. The first number of Player B's Best Average is entered in field 9 and the second number of Player B's Best Average is entered in field 10. The program calculates and displays in field 11 the handicap to be added to Player A's score. The program also calculates and displays in field 12 the handicap to be added to Player B's score. With these adjustments to the score, Players A and B will be evenly matched.

Secondly, the computer can also provide players with a Target (T) score for a bonus. The target for each player is the number of points he or she must score in order to receive an additional bonus. The program calculates and displays a target number for Player A in field 13, which is the score he/she must reach to be awarded the bonus. The computer similarly calculates and displays a target number for Player B in field 14, which he/she must reach to be awarded the bonus.

The target is calculated by determining the number of points that a player is expected to score in a match against a particular opponent. The program calculates this by multiplying the percentage of games a player is expected to win (because a player only scores if he/she wins), the expected number of points the player is expected to be awarded in a victory (which the program assumes is the player's opponent's best average), and the number of rounds in the match.

Each player's target is calculated by multiplying: (a) the percentage assigned above to the other player, (b) the other player's best average and (c) the number of rounds in the match. The computer subtracts the smaller of the two targets from the larger of the two targets, and the difference is the handicap assigned to the player with the weaker average.

As said before, the computer systems in the preferred embodiments of the invention are well suited to conventional billiards games, such as Eight-ball, Nine-ball, and Ten-ball.

The break counts from such conventional games can be entered so as to obtain player ratings and handicaps as described. In addition to such Standard Play, the computer systems are especially valuable when used in conjunction with alternative methods of scoring and playing Eight-Ball, Nine-Ball, and Ten-Ball in a solo scored format (called "Scored Play") and an interactive format (called "Match Play"), which, by their nature, include an emphasis on the break counts.

Scored Play is a non-interactive format in which the object is to end the game with a low score (the lower a player's score is, the more successful his/her game was) rather than simply to beat an opponent (similar to way that in golf medal play, each player plays to achieve the best score he can rather than trying only to beat his opponents). Because Scored Play uses the break count as the scoring component, the statistics it naturally generates are well suited for the computer systems of the preferred embodiments. Scored Play's primary advantages are that it can be used to expedite the accumulation of break counts for rating purposes, that it can be used for a fast qualifying round prior to a tournament, and that it could be used as the opening round for seeding or elimination.

Scored Play is comprised of a predetermined number of rounds. If there is one player participating, there is one game per round. If there are two players competing, there are two games per round. The number of games in a round is equal to the number of players competing, with each player playing one game per round. A game of scored play consists only of the break inning. The game ends when a player misses a shot, fouls, or pockets all of the balls on the table (which is to say, when a player misses a shot, he/she does not continue shooting nor does he/she turn the table over to his/her opponent with the balls remaining where they were when the player missed). At the end of the break inning, the game is complete and the balls are gathered and racked to start the next game for the next player. Scored play is a solo scored game, which means that only one player scores in each game.

Scored Play begins with the first player breaking the balls. If the first player fouls on the break, the break inning is over, the first player's break count is taken (as previously described in this patent application) and recorded for Round 1. If the game is Eight-ball and there is a foul in which the cue ball left the table (jumped over the side rail), the lower of the counts from each group of low (1-7) and high (9-15) ball is recorded as the break count. If the first player executes a legal break, they continue to shoot, whether or not a ball is made on the break, until they miss a shot, foul, or win the game. A missed shot, a foul, or a game win marks the end of the break inning. At the conclusion of the break inning, a break count is taken (as previously described in this patent application) and recorded for that player for Round 1. After the first player records their break count in each round, a running total of his/her break counts is tallied, the balls are gathered, racked, and the second player begins his/her turn.

The second player and each additional player breaks the balls following the same procedure prescribed above for the first player, and records the break count for Round 1, and the running total of his/her break counts is tallied after each round. The balls are then gathered, racked, and the next player begins his/her turn.

As the match proceeds, all players accumulate scores until the predetermined number of rounds is completed and a winner is determined. In the event of a tie, an additional round is played to break the tie. Since the break count is the central focus of Scored Play, it is less interrupting to record the break counts than in conventional billiard games.

The user interface shown in FIG. 35 may also be used to guide an alternative game called "Match Play" utilizing the handicaps in which performance is recorded in the form of break count, to score the match. Although not shown in FIG. 35, the match information may include the date, time, location, table, table size selection, event, and player ID Numbers. Also, the computer may print a score sheet that is comparable to the user interface in FIG. 35.

The object of the match play is to score more points than one's opponent. A match is comprised of a predetermined number of rounds (the example in FIG. 35 has 10 rounds). A round is comprised of one game in which Player A breaks and one game in which Player B breaks. In each game, the player who does not break plays offense (only he/she can score points) and the player who breaks plays defense. While the player who breaks cannot score points, he/she can, by winning the game, prevent his/her opponent from scoring any points. Players take turns breaking and racking (and thus, take turns playing offense and defense).

At the start of the match, Player B begins the break inning by breaking the balls. If Player B 13 fouls on the break, the break inning is over, a break count is taken (as previously described in this patent application) and is recorded for Round 1. If the game is Eight-ball, then the lower of the two counts for each group of balls is recorded as the Break Count. If Player B executes a legal break, then he or she continues to shoot, whether or not a ball is made on the break, until they miss a shot, foul, or win the game. A missed shot, a foul, or a game win marks the end of the break inning. At the conclusion of the break inning, a break count is taken (as previously described in this patent application) and recorded for Round 1.

The recording of Player B's break count establishes the number of points for which Player A plays. The game is then played to conclusion. If Player A wins the game, Player A is awarded points equal to Player B's break count and the points are recorded in the Rack Score box 20. If player A loses the game, Player A is awarded no points and a "0" is recorded in the Rack Score box in FIG. 35. A running total of all points awarded to Player A is recorded in the HDCP+Total box. Player B cannot win any points but instead can, by winning the game, prevent Player A from scoring points.

Rolls are then reversed whereby Player A breaks and plays defense (seeks to prevent his/her opponent from scoring) while Player B racks and plays offense (attempts to score points). Player A breaks and plays out the break inning. Player A records a break count. The break count of Player A establishes the number of points for which Player B plays. If Player B wins the game, Player B is awarded points equal to Player A's break count and this number is recorded in the Rack Score Box. If Player B loses the game, Player B is awarded no points and a "0" is recorded in the Rack Score box. A running total of all points awarded to Player B is recorded in the HDCP+ Total box. Player A cannot win any points but instead can, by winning the game, prevent Player B from scoring points.

As the match proceeds, both players accumulating points until either the predetermined number of Rounds is completed and a winner is determined, or until it is mathematically impossible for one of the players to win the match. In the event of a tie, an additional round is played to break the tie.

This improved method of match play has the advantage that the break count serves as the significant number that determines scoring. The players need to keep track of the break count during the round in order to score the game. Because the break count must be remembered during the round, the need to record the break count (in order to develop a player rating) does not seem like an artificial imposition on the game.

In a preferred embodiment of the invention, the computer prompts the entry of the players' break counts into the computer during each round. The computer displays the break count while the player on offense plays, providing a visual cue of the count that the player on offense must achieve in order to win the round. Once the player on offense finishes their break inning, the user interface in FIG. 35 is updated with the score for the round. Once the user interface 35 is updated with the score for the round, there is no longer any need for the break count to be displayed. Preferably, the computer system automatically enters the break count into the file for the player on defense and the break count can be used to calculate the player's rating in the manner previously described in this application.

While this invention has been shown and described with reference to certain preferred embodiments, the invention is not limited to such preferred embodiments and modifications, alterations, and variations may be made to the preferred embodiments while still remaining within the scope of the appended claims.

We claim:

1. A computerized billiards player rating system comprising:

a computer;

a display associated with the computer;

at least one storage device; and a computer program stored in said storage device, said computer program when executed by said computer, causing said computer to determine a universal rating for a billiards player by:

prompting the entry of break counts of the billiards player into the computer with a user interface displayed on the display;

determining a current average of the break counts entered into the computer for the billiards players;

determining a best average of the break counts entered into the computer for the billiards player; and calculating the universal rating for the billiards player from the current average and best average of break counts.

2. The computerized billiards player rating system recited in claim 1, further comprising a database storing break count data for the billiards player.

3. The computerized billiards player rating system recited in claim 2, wherein the system further comprises a central site, and the central site includes the database and calculates the ratings of a plurality of billiard players.

4. The computerized billiards player rating system recited in claim 3, wherein the central site communicates with a plurality of computers over a network, receives break counts of the plurality of players entered into the plurality of computers and returns universal ratings for the plurality of players to the plurality of computers.

* * * * *

UNITED STATES PATENT AND TRADEMARK OFFICE

CERTIFICATE OF CORRECTION

PATENT NO. : 8,105,174 B1
APPLICATION NO. : 12/605064
DATED : January 31, 2012
INVENTOR(S) : Schofield, Sr. et al.

It is certified that error appears in the above-identified patent and that said Letters Patent is hereby corrected as shown below:

On the title page, item [60] Related U.S. Application Data, change "60/766,927" to --60/766,929--; and In the Specification Column 1, lines 8-9, change "60/766,927" to --60/766,929--.

Signed and Sealed this
Seventeenth Day of February, 2015

Michelle K. Lee

Michelle K. Lee
*Deputy Director of the United States Patent and Trademark Office*